US011883754B2

(12) United States Patent
Schultheis et al.

(10) Patent No.: US 11,883,754 B2
(45) Date of Patent: Jan. 30, 2024

(54) BATTLING ENVIRONMENT WITH MULTIPLE PLAY LEVEL SURFACES

(71) Applicant: Hasbro, Inc., Pawtucket, RI (US)

(72) Inventors: Douglas Arthur Schultheis, Cumberland, RI (US); Luke C Lohan, Abington, MA (US); Hiroyuki Hama, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 0 days.

(21) Appl. No.: 17/150,813

(22) Filed: Jan. 15, 2021

(65) Prior Publication Data

US 2021/0220724 A1 Jul. 22, 2021

Related U.S. Application Data

(60) Provisional application No. 62/962,280, filed on Jan. 17, 2020.

(51) Int. Cl.
*A63F 9/16* (2006.01)

(52) U.S. Cl.
CPC ..... *A63F 9/16* (2013.01)

(58) Field of Classification Search
CPC ..... A63F 9/16; A63F 9/04; A63F 3/02; A63B 71/00
See application file for complete search history.

(56) References Cited

U.S. PATENT DOCUMENTS

| | | | |
|---|---|---|---|
| 755,446 | A | 3/1904 | Butcher |
| 1,594,649 | A | 8/1926 | Trautmann |
| 2,148,374 | A | 2/1939 | Hogan |
| 2,195,083 | A | 3/1940 | Einfalt |
| 2,364,117 | A | 12/1944 | Wigal |
| 2,611,995 | A | 9/1952 | Krapp |

(Continued)

FOREIGN PATENT DOCUMENTS

| | | | |
|---|---|---|---|
| EP | 3207969 | A1 | 8/2017 |
| JP | 4659153 | B2 | 3/2008 |

(Continued)

OTHER PUBLICATIONS

PCT/US21/013708 ISR Transmittal, Written Opinion, and ISA Search 1-748 PCT papers dated May 10, 2021.

(Continued)

*Primary Examiner* — Eugene L Kim
*Assistant Examiner* — Christopher Glenn
(74) *Attorney, Agent, or Firm* — Perry Hoffman

(57) ABSTRACT

A battling stadium game apparatus and methods for toy tops providing multiple play level surfaces which may include platform inserts to actively direct interactions of spinning tops across multiple play level surfaces, a base, concave areas at a first play level surface at the base, concave areas with battling surfaces at the first play level. The battling surface includes a middle area and a periphery area surrounding the middle area, an overdrive surface disposed at a second play level surface at the base, the overdrive surface is at a level elevated from the concave arena. A lid nests within the base and defines an exterior wall around the perimeter of the base, with a third level platform element between the base and the lid for a third play level surface.

20 Claims, 26 Drawing Sheets

(56) References Cited

U.S. PATENT DOCUMENTS

| | | | | | |
|---|---|---|---|---|---|
| 2,736,132 | A | | 2/1956 | Murray | |
| 3,229,416 | A | | 1/1966 | Bross | |
| 3,235,259 | A | | 2/1966 | Glass et al. | |
| 3,531,892 | A | | 10/1970 | Pearce | |
| 3,643,954 | A | * | 2/1972 | Meyer | A63F 9/02 273/129 R |
| 3,841,636 | A | | 10/1974 | Meyer | |
| 3,843,133 | A | * | 10/1974 | Brown | A63F 3/022 101/368 |
| 3,864,870 | A | | 2/1975 | Breslow et al. | |
| 3,884,469 | A | * | 5/1975 | Morton | A63F 7/0628 273/120 R |
| 3,945,146 | A | | 3/1976 | Brown | |
| 4,185,739 | A | | 1/1980 | Wilford | |
| 4,200,283 | A | | 4/1980 | Andrews et al. | |
| 4,261,466 | A | | 4/1981 | Wilford | |
| 4,476,650 | A | | 10/1984 | Lokvig | |
| 4,630,822 | A | * | 12/1986 | Massaglia | A63F 7/04 273/118 A |
| 4,695,262 | A | | 9/1987 | Crosby et al. | |
| 4,713,039 | A | | 12/1987 | Wong | |
| 4,867,727 | A | | 9/1989 | Anius | |
| 4,959,035 | A | | 9/1990 | Murasaki | |
| 4,982,961 | A | | 1/1991 | Ichimura | |
| 5,110,128 | A | | 5/1992 | Robbins | |
| 5,375,828 | A | * | 12/1994 | Shikami | A63F 9/001 273/110 |
| 5,411,138 | A | | 5/1995 | Klawiter | |
| 5,458,523 | A | | 10/1995 | Aoki et al. | |
| 5,516,112 | A | * | 5/1996 | Rypinski | A63F 9/0402 273/287 |
| 5,823,845 | A | | 10/1998 | O'Berrigan | |
| 5,896,991 | A | | 4/1999 | Tippely et al. | |
| 5,957,745 | A | | 9/1999 | Johnson et al. | |
| 6,099,380 | A | | 8/2000 | Rasmussen | |
| 6,270,391 | B1 | | 8/2001 | Emilsson | |
| 6,280,286 | B1 | | 8/2001 | Andrews | |
| 6,406,349 | B1 | | 6/2002 | Chung | |
| 6,676,476 | B1 | | 1/2004 | Lund et al. | |
| 7,037,169 | B2 | | 5/2006 | Benedek et al. | |
| 7,296,679 | B2 | | 11/2007 | Lam | |
| 7,389,987 | B1 | | 6/2008 | Paukert | |
| 7,475,881 | B2 | | 1/2009 | Blagg et al. | |
| 7,740,518 | B2 | | 6/2010 | Elliott | |
| 8,137,151 | B2 | | 3/2012 | Kenney | |
| 9,962,615 | B2 | | 5/2018 | Lema et al. | |
| 2003/0168801 | A1 | | 9/2003 | Zucchi et al. | |
| 2004/0040349 | A1 | | 3/2004 | Guttadauro et al. | |
| 2005/0104294 | A1 | | 5/2005 | Chen | |
| 2006/0255149 | A1 | | 11/2006 | Retter et al. | |
| 2010/0320682 | A1 | * | 12/2010 | Derrah | A63H 7/00 273/108.1 |
| 2016/0030848 | A1 | | 2/2016 | Lema et al. | |
| 2016/0035178 | A1 | | 2/2016 | Judkins et al. | |
| 2017/0239558 | A1 | * | 8/2017 | Shindo | A63H 1/00 |
| 2019/0143200 | A1 | * | 5/2019 | Villela | A63F 3/00003 273/146 |

FOREIGN PATENT DOCUMENTS

| | | | |
|---|---|---|---|
| WO | 2011158940 | A1 | 12/2011 |
| WO | 2013016317 | A2 | 1/2013 |
| WO | 2016109934 | A1 | 7/2016 |

OTHER PUBLICATIONS

Beyblade Burst Turbo Slingshock Cross Collision Battle Set, https://www.YouTube.com/watch?v=WNI-hBsNhLA, Mar. 29, 2019.

* cited by examiner

BATTLING ENVIRONMENT WITH MULTIPLE PLAY LEVEL SURFACES

PRIORITY CROSS-REFERENCE TO RELATED APPLICATION

This application claims priority pursuant to 35 U.S.C. 119(e) or 120 from U.S. Provisional Application No. 62/962,280 filed Jan. 17, 2020 for inventions disclosed therein.

FIELD OF THE INVENTION

The present invention relates to a battle arena apparatus, and more particularly, to a battling stadium game apparatus with multiple play level surfaces for dynamic and exciting play for a user employing at least a third level platform insert creating directional play and directed one-way flow patterns to actively direct interactions of spinning tops enhancing game play across multiple play level surfaces.

BACKGROUND OF THE INVENTION

The inventions discussed in connection with the present described embodiments address various deficiencies of the prior art. The present inventions address a battling stadium game apparatus which enhances play by employing multiple play level surfaces and at least a third level platform insert creating directional play and one-way flow patterns for maximizing interactions between actively spinning tops at middle, intermediate, or lower areas of a battling surface where collisions are most likely to occur.

There are known toy top play pads, toy top entertainment systems, and battle arenas which provide a surface along which toy tops are spun, travel in a specified direction along a rail element, or travel around on a circular platform. It is known to employ a circular arena for providing a surface on which toy tops can spin and possibly interact with one another, or to provide a rail element to guide a toy top along the direction of the rail.

There is a known toy top play pad which employs a circular launch pad and runway pad in juxtaposition with the launch pad as exemplified and disclosed in JP4659153 titled Game Table for a toy top, issued Mar. 27, 2008 to Jenoido Proto Design K K. Toy tops are spun into the circular launch pad where they revolve around the perimeter of the concave launch pad and discharge onto a runway pad in a racing fashion. A guide plate directs the tops only from the launch pad to the running pad where a user can race tops through running grooves and compete for running speeds. The running grooves are carved into the runway pad and are designed to capture a tip of the toy tops as they enter the runway pad. The running grooves cut into the surface of the runway pad and direct the tops to circle around the perimeter of the play pad. The tip of each toy top is circular in shape and comes into point contact with the bottom surface of the running groove to allow the tip of the top to rotate and spin as it travels within the running groove. The circular tips of the spinning tops rolls along the running groove and circles the perimeter of the play pad in a racing fashion.

The circular launch pad is only a landing pad for toy tops to be introduced to the play pad before they are captured by the running grooves as the toy tops circle the outer perimeter of the circular launching pad. The toy tops enter the running grooves and are then directed around the runway pad circuit in a racing fashion and never collide in the circular launch pad nor are the runway pads guiding the tops into the middle of the circular launch pad to encourage collisions between the spinning toy tops. There is only an entrance into the runway pad from the circular launching pad without any disclosure for an exit from the runway pad to the circular launching pad for directing tops back to the circular launch pad, from the running pad, to collide with other spinning tops. The running pad has only an entrance from the circular launching pad, without any exits back to the circular launching pad preventing spinning tops from redirection into the middle of the circular launch pad.

There is also a known toy top entertainment system with interchangeable top components and interchangeable rail arrangements as exemplified and disclosed in WO 2013/016317 A2 Dynamic Entertainment System, published Jan. 31, 2013 to Gaines. The top entertainment system discloses interchangeable tops engaging and riding along interchangeable rail elements to maximize vector velocity in transit along the rail elements. The toy tops are launched onto a flat launch support adjacent a rail element. The tops have a ring with a ring side wall perpendicular with a pivoting axis and capable of engaging a rail side wall of the rail elements of the rail path in rolling line contact to travel along the line of the rail path.

Additionally, there are known battle arena game apparatuses including an arena or stadium for a game of spinning battle tops. The arena can accommodate two players when placed in one orientation and four players after being flipped to another configuration. Also, the circular stadium-shaped game board that may be integrated with a computer.

Beyblade™ spinning tops are known as physical game pieces. The described Beyblade™ spinning top usually includes a device, such as a ripcord, to help a player make the top spin. One or more players may engage in games where one or more players spin two or more tops so that the tops may "battle", where the player whose top is the last top spinning wins. The "battle" may include the tops colliding one or more times. The tops may have different designs where each design causes a top to respond to collisions in a unique way, thus adding a skill element to choosing opposing tops. In some embodiments, the game may further use physical game battle arena game apparatus in an integrated multi-environment interactive battle game physical game board, convertible or converting arena, e.g., being turned upside down and used as a stadium for plural or multiple players to spin two or more Beyblade™ tops so that the tops battle within the stadium confines by spinning and knocking into each other until only one top remains spinning.

Significantly, known toy top play pads and arenas do not include multiple play level surfaces for directing dynamic play and accommodating a directed experienced for each user with users battling spinning toy tops across three levels of game play. Additionally, none of the known top play pads or arenas employs a third level platform insert for creating directional play by launching spinning toy tops into a middle area of a battling surface for combat and/or creating one-way flow patterns directing spinning toy tops across multiple play level surfaces.

SUMMARY OF THE INVENTION

The present invention addresses shortcomings of the prior are to provide a battling stadium game apparatus with three play level surfaces for one or more spinning toy tops for enhancing game play for a user, and simply yet uniquely employing a third level platform insert for creating directional play and one-way flow patterns to maximize interactions between actively spinning tops for enhanced game play and fun for a user.

In one embodiment of the invention, a battling stadium game apparatus with three play level surfaces for toy tops, includes a base, at least one concave arena at a first play level surface at the base, the at least one concave arena having a battling surface at the first play level. The battling surface includes a middle area and a periphery area surrounding the middle area, an overdrive surface is further included and disposed at a second play level surface at the base, the overdrive surface is at a level elevated from the concave arena. A lid nests within the base and defines an exterior wall around the perimeter of the base, and a third level platform element is disposed between the base and the lid at a third play level surface. The overdrive surface and/or the third level platform directs interactions between spinning tops by creating a one-way flow patterns about three play level surfaces so each of the users' toy tops are directed for an enhanced experience.

The disclosed toy top stadium arenas are configured so that the range in which the tops run around is controlled by the field, and the tops run around on the field to battle the top toys in which an unexpected battle can be enjoyed. According to this stadium, the running range of the pieces is regulated by the field, so that the probability of the pieces colliding with each other is increased, and it is possible to play with the battle effectively. The stadium that is used to battle the top together which rotates on a predetermined field, the first surface material portion forming the first field, than the first field A second face material portion forming a second field at a high position, and a slope connecting the first field and the second field and running a top in the first field up to the second field. By the way, in the invention described in the above-mentioned prior art document 1, since the tops only run around the field extending in a substantially horizontal direction and collide with each other, the battle mode between the tops is easy to predict and has little unexpectedness.

A stadium used to battle rotating pieces on a predetermined field, wherein a first face material forming a first field and a second field is formed at a position higher than the first field. And a slope connecting the first field and the second field, and allowing a top in the first field to run up to the second field. The second means is the first means, wherein the first field and the second field are juxtaposed in one direction in plan view, and are orthogonal to the juxtaposition direction of the first field and the second field. One of the slopes is provided at each of both ends in the direction of movement. The third means is the second means, wherein a cliff for dropping a top of the second field to the first field is provided between two slopes at an edge of the second face member. It is characterized by having been done. The fourth means is the third means, wherein the upper surface of the second face member is inclined so as to have a downward gradient toward the first field. The fifth means is the third means or the fourth means, wherein a step is provided between the first field and the cliff for preventing a body of a coma from contacting a wall constituting the cliff. It is characterized by being provided. The sixth means is any of the first means to the fifth means, wherein a mortar-shaped recess is formed in a central portion of an upper surface of the second field. The seventh means is any one of the first means to the sixth means, wherein the slope is formed on the slope so that the outer peripheral surface of the shaft portion is suitable for an inverted conical top which is generally enlarged toward the body. Is characterized in that a cant for rolling the top is provided on the outer peripheral surface of the shaft portion. Eighth means is the seventh means, wherein the slope is steeper in the cant toward the second field. The ninth means is the seventh means or the eighth means, wherein the direction of the rolling surface at the end of the slope on the side of the second field is such that the top that has run up faces the center of the second field. It is characterized by being set to change. A tenth means is any of the first means to the ninth means, wherein a groove for catching the repelled top is formed outside the field. An eleventh means is any of the first means to the tenth means, wherein the first face member is formed on a bottom plate, and the second face member is detachable from the bottom plate. In a state in which the second face member is removed, a third face member forming a third field connected to the first field is exposed on the bottom plate. A twelfth means is the eleventh means, wherein a first fence having a constant height for preventing a top from jumping is detachably provided on an edge of the bottom plate. A thirteenth means is the twelfth means, wherein the first fence is provided with a second fence which surrounds three sides except the first field side and which prevents a top from jumping out of the second field. It is characterized by being provided as possible. The fourteenth means is any one of the eleventh means to the thirteenth means, wherein the second surface member is fixed to the bottom plate in a cantilever state on the first field side, and the free end side of the member is configured to be suspended on the second fence by a suspension component. According to the first means, the tops can be battled in the first field, and the tops released in the first field can run up on the slope to battle each other in the second battle feel. At that time, the tops run not only in the horizontal direction but also in the vertical direction.

According to the second means, since the slopes are provided at both ends in the direction orthogonal to the direction in which the first field and the second field are arranged in parallel, it is possible to run up the coma having different rotation directions to the second field can be made. According to the third means, since the top of the second field falls from the cliff to the first field, an attack from above becomes possible, and a three-dimensional battle can be enjoyed. According to the fourth means, the top of the second field easily falls from the cliff to the first field. According to the fifth means, since the step is provided, the torso of the top does not collide with the wall, and deceleration due to the body can be prevented. According to the sixth means, the top is easily retained in the mortar-shaped concave portion in the second field, and the possibility of a battle in the concave portion can be increased. According to the seventh means, since the cant is attached, the top comes into wide contact with the outer peripheral surface of the shaft portion, and the top can easily run up. According to the eighth means, the upper portion of the outer peripheral surface of the shaft portion gradually comes into contact with the tight cant, and the top runs up the slope while increasing the speed. According to the ninth means, the tops running up the slope gather at the center of the second field, so that the possibility of a battle at the center of the second field can be increased accordingly. According to the tenth means, by catching the repelled top by the groove, it is possible to make it difficult for the top which has come out of the field to return to the field. According to the eleventh means, a battle can be performed using the first field and the third field when the second field is removed. According to the twelfth means, it is possible to prevent the top from jumping out of the field by the first fence. According to the thirteenth means, it is possible to effectively prevent the top from jumping out of the second field by the second fence. According to the fourteenth means, the free end side of the second face member is suspended from the second fence by the suspending part, so that the free end side of the second face part is directly fixed to the bottom plate. The thickness at the free end side of the second face member can be made smaller than that of the first embodiment.

BRIEF DESCRIPTION OF THE DRAWINGS

For the purpose of facilitating an understanding of the inventions, the accompanying drawings and description illustrate a preferred embodiment thereof, from which inventions, structures, construction and operation, and many related advantages may be readily understood and appreciated.

FIG. 1B is a cross sectional view illustrating a portion of the first play level surface, while

DETAILED DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1A:
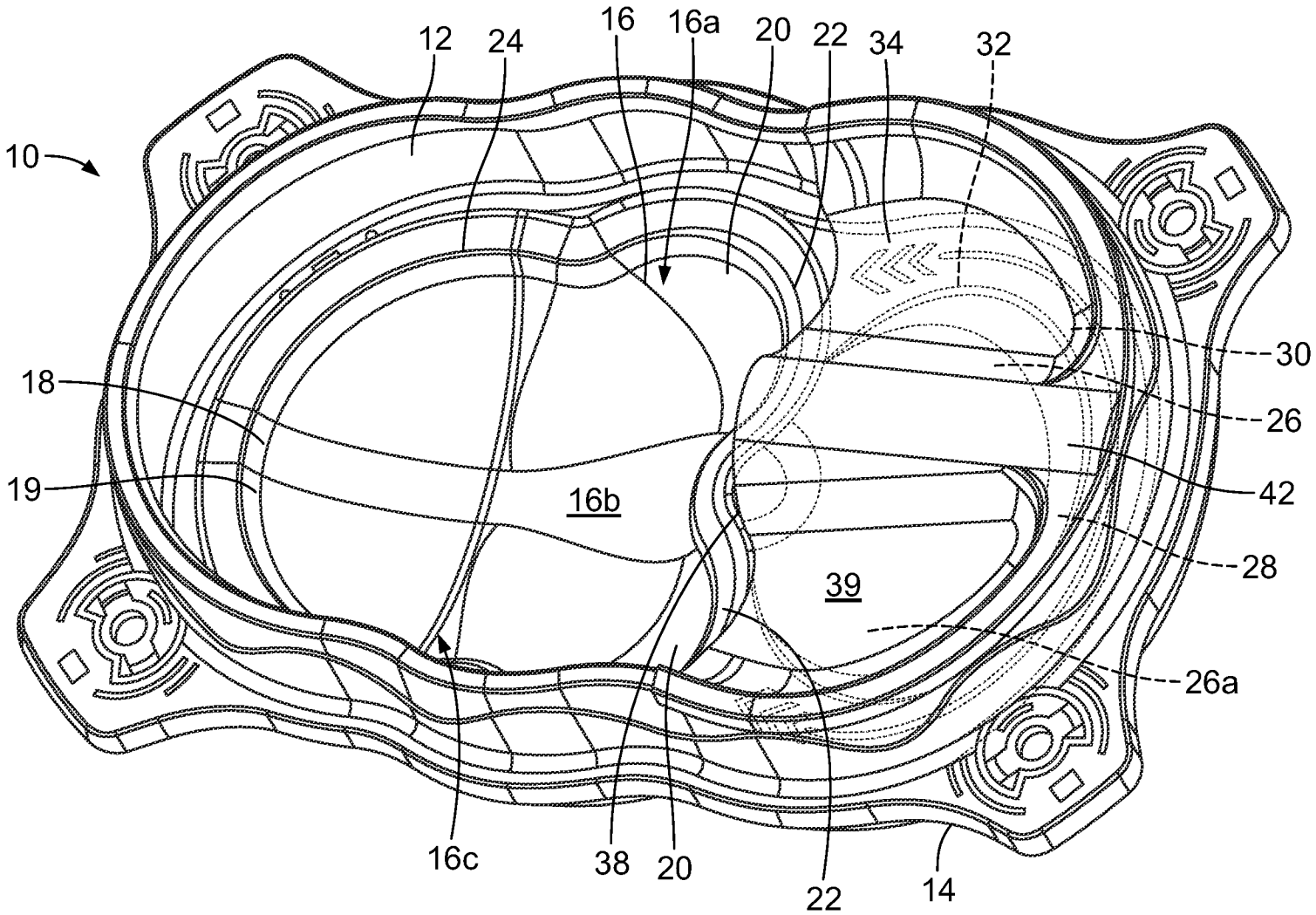
FIG. 1A is a perspective view of a battling stadium game apparatus of the present invention illustrating multiple play level surfaces with a third level platform inserted into a lid of the stadium.
Figure 1B:
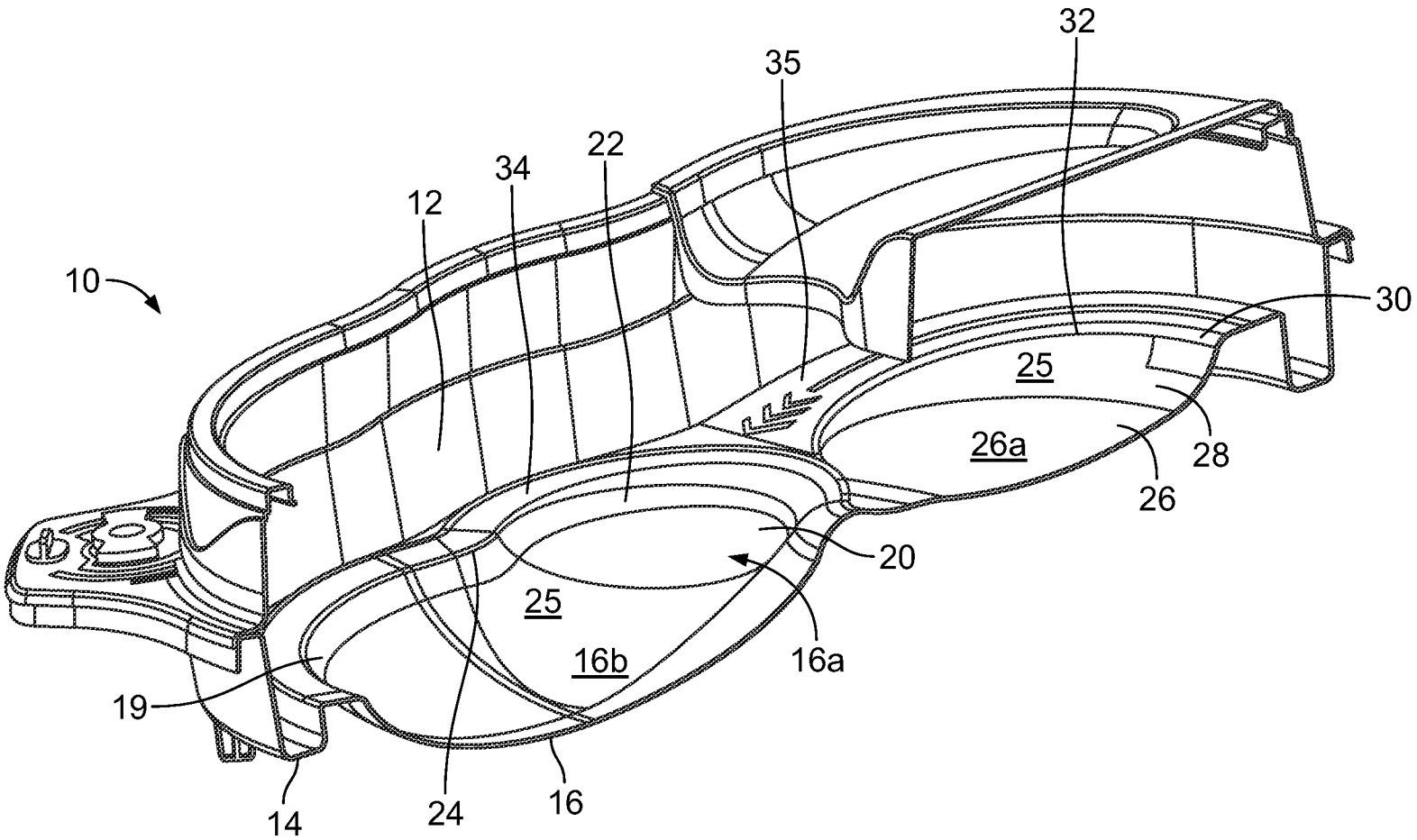
Figure 1C:
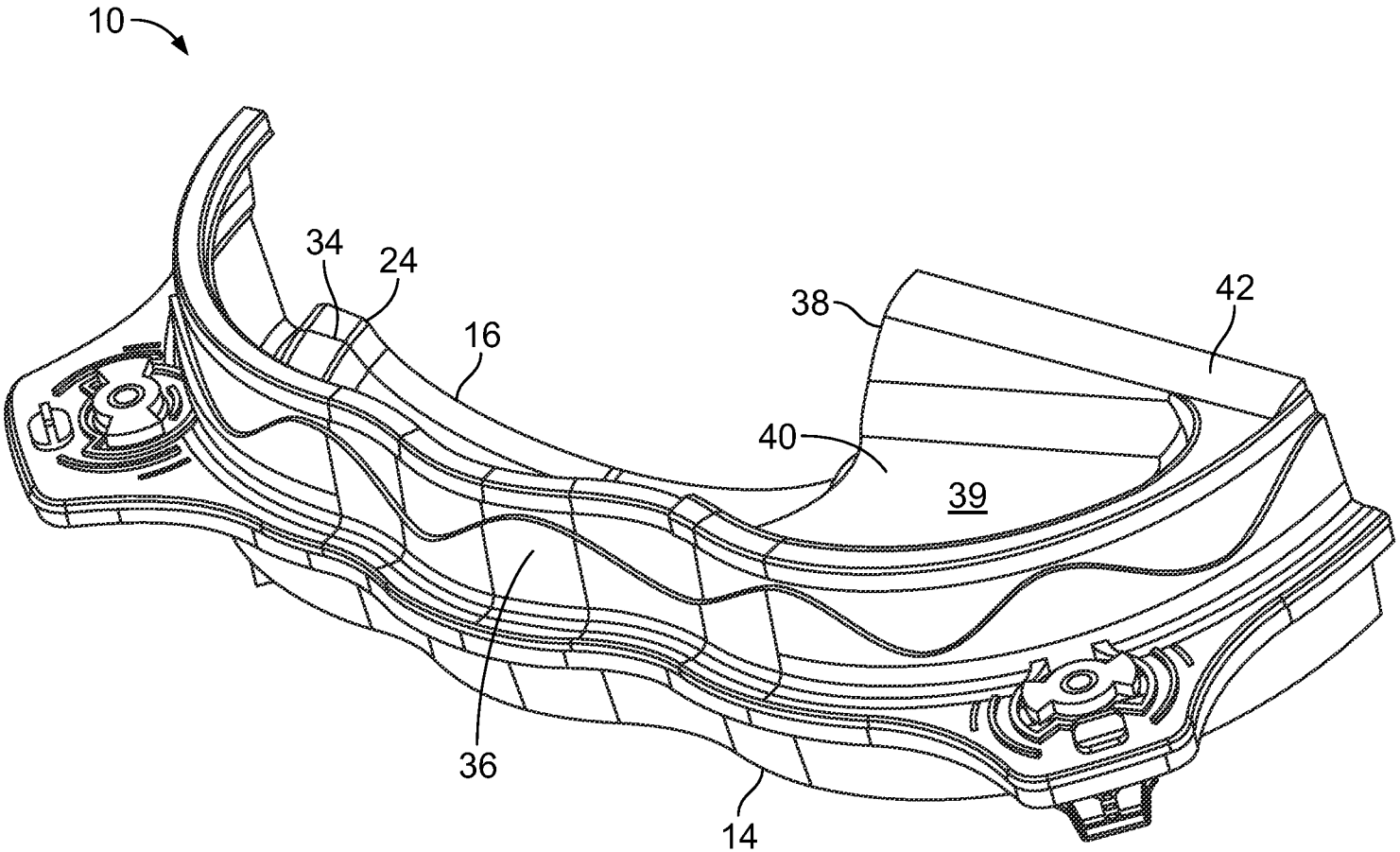
FIG. 1C is cross sectional view, opposite FIG. 1B, illustrating a portion of the first play level surface and a cross sectional view of the third level platform insert.

A toy battling stadium game apparatus 10, as seen in FIGS. 1A, 1B, & 1C, includes multiple play level surfaces for dynamic and exciting game play employing a third level platform insert for creating directional play and one-way flow patterns to maximize the interactions between actively spinning tops enhancing game play across multiple play level surfaces. The battling stadium game apparatus 10, provides a contained space in which toy tops can be launched and is generally a one-piece molded plastic stadium-like apparatus with an exterior wall 12 to contain the spinning tops within.

Figure 2:
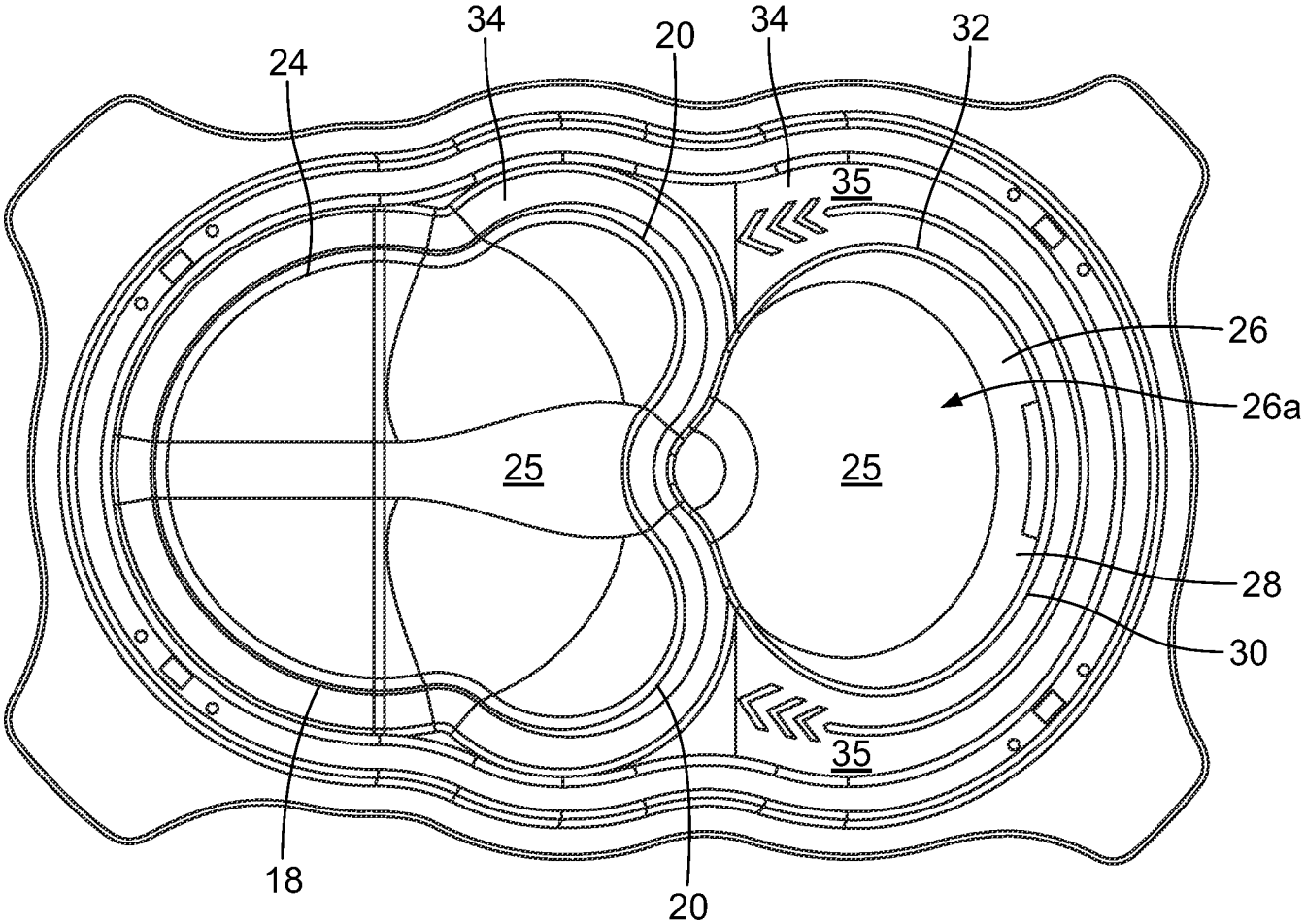
FIG. 2 is a plan view of the battling stadium illustrating two play level surfaces as the third level platform is omitted from the stadium.
Figure 3:
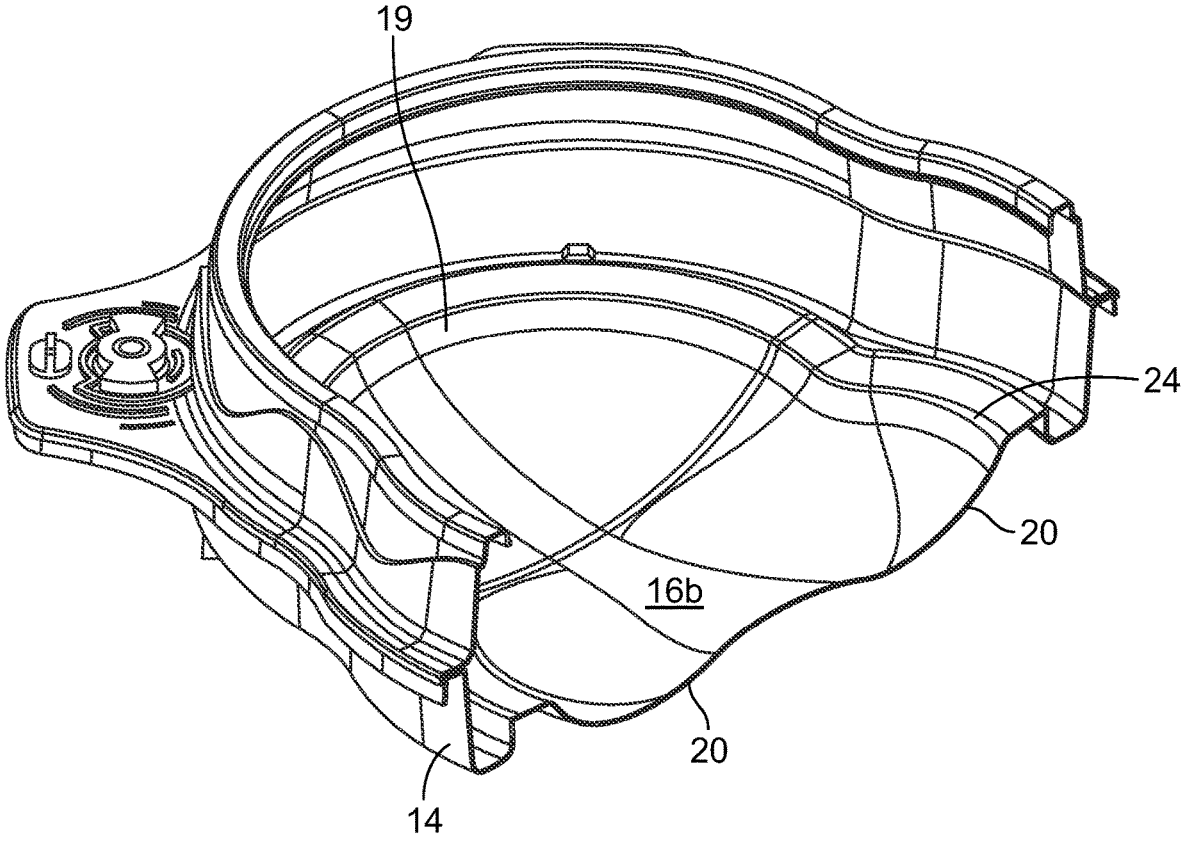
FIG. 3 is a cross sectional view of the battling stadium game apparatus illustrating an irregular battling surface of a concave arena of the stadium.

The battling stadium game apparatus includes a base 14 and at least one concave arena 16 having a battling surface 16*a* for one or more toy tops to engage each other in combat, as seen in FIGS. 1-3. The battling surface includes a middle/central area 16*b* and an outer periphery area 16*c* surrounding the middle area. The concave arena can be generally circular or elliptical in shape, and in the present described embodiment, the concave arena generally includes a partial elliptical portion 18 with two symmetrical mini semi-circular pocket portions 20 pushing out away from a long side of the partial elliptical portion. The main elliptical portion is shallower at the middle/central area 16*b* with a sharp inclined surface at a banked side 19 opposite the mini semi-circular portions, defining a deep-seated surface at the banked side, as seen in FIG. 3. The two symmetrical mini semi-circular portions 20 each include a banked corner 22 defined by a partial sphere. Combining various shaped dimensions into the concave arena creates an asymmetrical battling surface 16*a* which generates randomness to the battling surface 16*a* for interesting and exciting game play.

Figure 4:
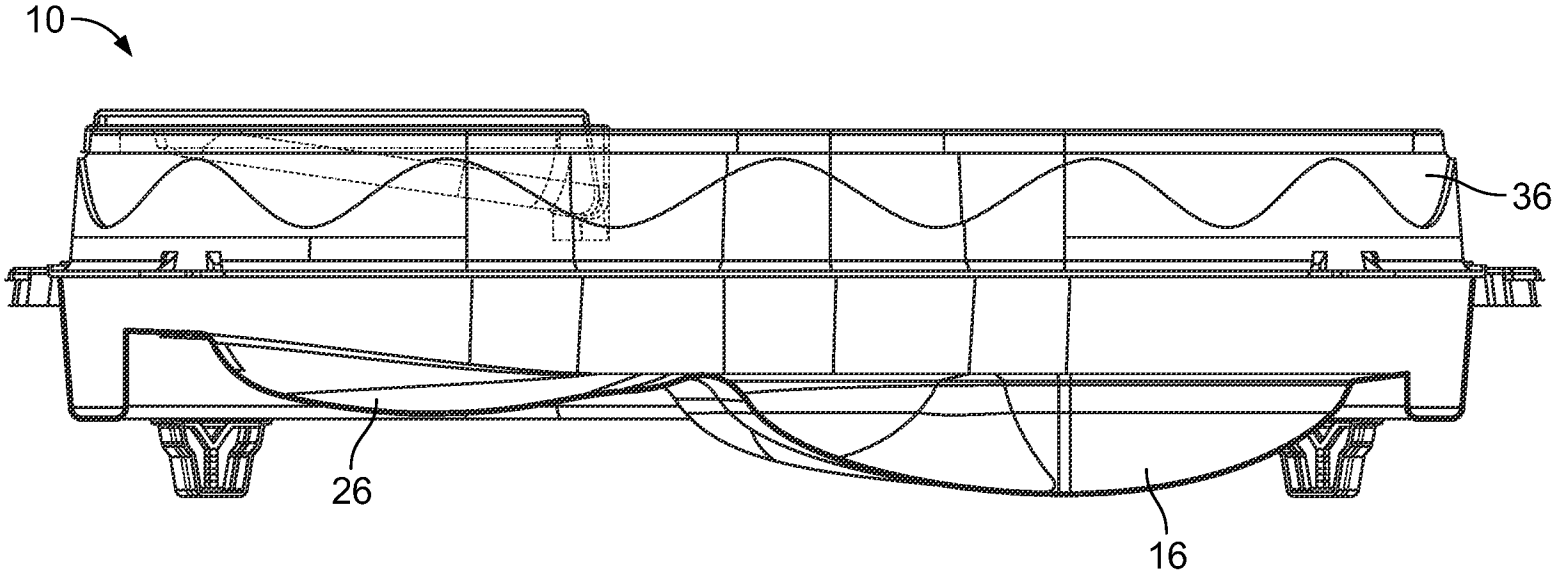
FIG. 4 is a perspective view of a long side of the battling stadium game apparatus illustrating a depth of the concave arena at a base of the stadium with respect to the second play level surface and a lid secured to the base defining an exterior wall elevated from the second play level surface.

A secondary concave arena 26 is disposed at the base and is generally circular in shape and includes a banked corner 28 defined by a partial sphere and a top traveling surface 26*a*, as seen in FIG. 1, beneath a third level platform element, discussed herein and in FIGS. 1B & 2. The secondary concave arena 26 is disposed adjacent the first main arena 16 but is much smaller in size and shallower in depth, as seen in FIGS. 1B & 4. An acceleration rim 30, as seen in FIGS. 1-2, defines a large portion of the banked corner 28 and provides a surface upon which spinning tops can travel to increase their velocity. The secondary concave arena 26 acts as a speed cradle adjacent the main concave arena 16 and battling surface 16*a* in order to propel spinning tops at a fast speed from the speed cradle to the battling surface 16*a* for combat.

A ridge 24 defines the uppermost perimeter around the main concave arena 16, and a second ridge 32, which encompasses acceleration rim 30, defines the uppermost perimeter around the secondary concave arena 26. Ridges 24 and 32 define the uppermost point of the first play level surface 25, with the first play level surface generally including battling surface 16*a* and secondary arena surface 26*a*, as seen in FIGS. 1B & 2. The first play level surface 25 is at base 14 and generally disposed within the main concave arena 16 and the secondary concave arena 26. The base 14 includes a long side and a short side and when viewing the first play level surface from a short side looking down onto the first level, as seen in FIG. 2, the first level play surface can resemble a baby bear image.

An overdrive surface 34 is disposed at a second play level surface 35 at the base, as seen in FIGS. 1A, 1B & 2. The overdrive surface is disposed at a level elevated from the main concave arena and the secondary concave arena 26. In the present described embodiment, the overdrive surface includes a generally flat platform area surrounding the concave arena and disposed between the concave arena and the exterior wall 12, having a surface upon which spinning toy tops ride when spinning out of the concave arena. On either side of the secondary concave arena 26 is an especially large portion of the platform arena which butts up against the banked corners 22 of the two mini semi-circular pocket portions 20 to provide game play at the second level play surface as spinning tops will frequently overdrive the banked corners 22 and jump to the second level play surface from the first level play surface. Spinning tops can also travel back into the concave arena 16 and secondary arena 26 at the first play level surface from the overdrive surface at the second play level surface.

Figure 7:
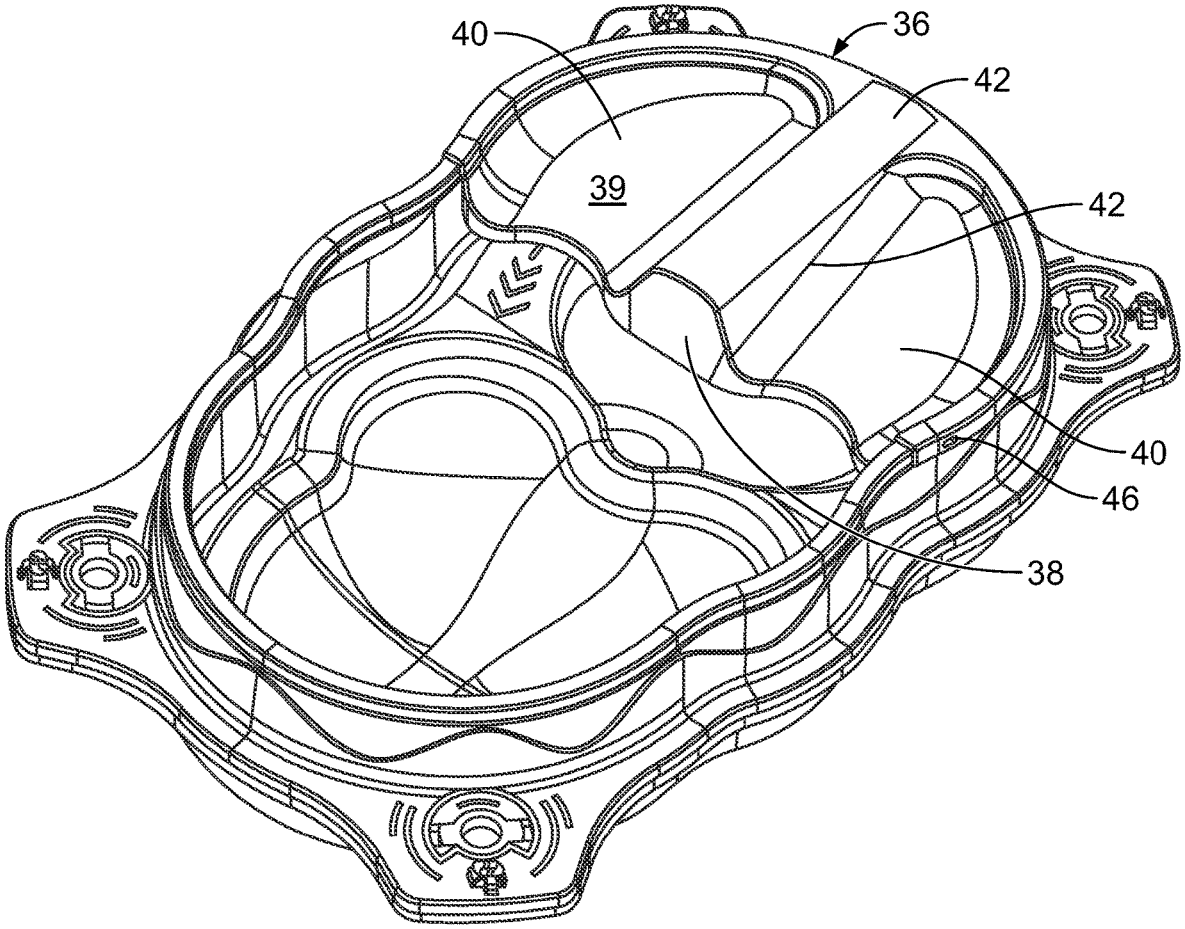
FIGS. 7 and 8A, 8B, and 8C are views for the couplings employed to secure the top layer, and lid to the base, securing therewith.
Figure 8A:
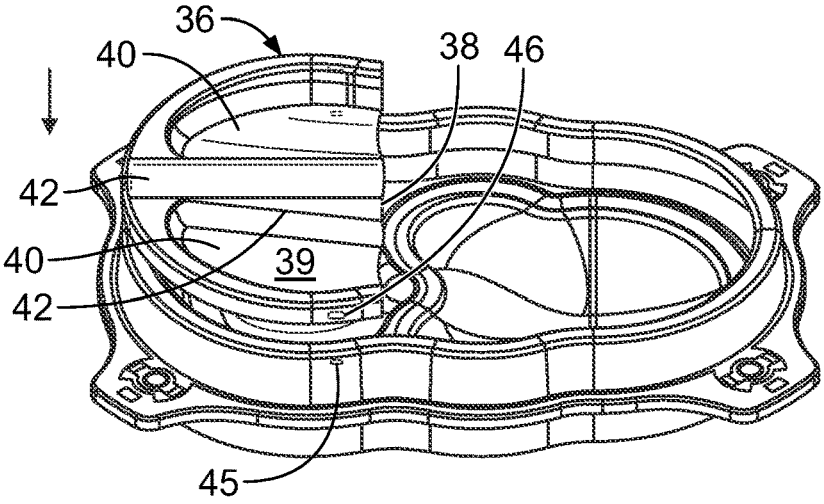
Figure 8B:
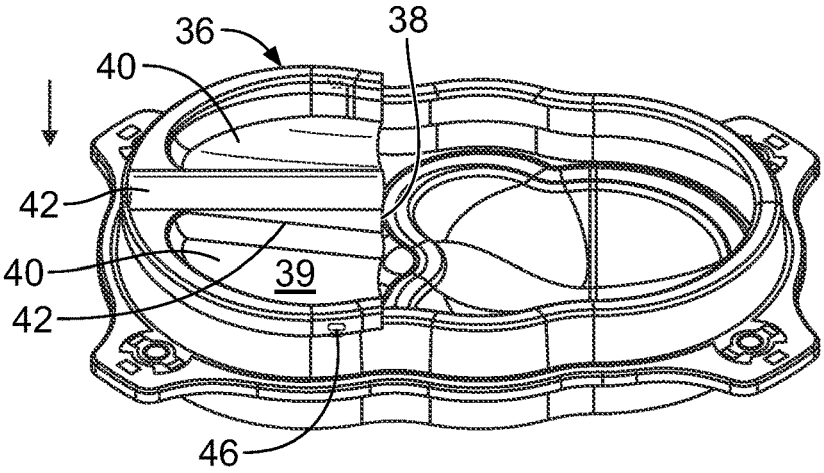
Figure 8C:
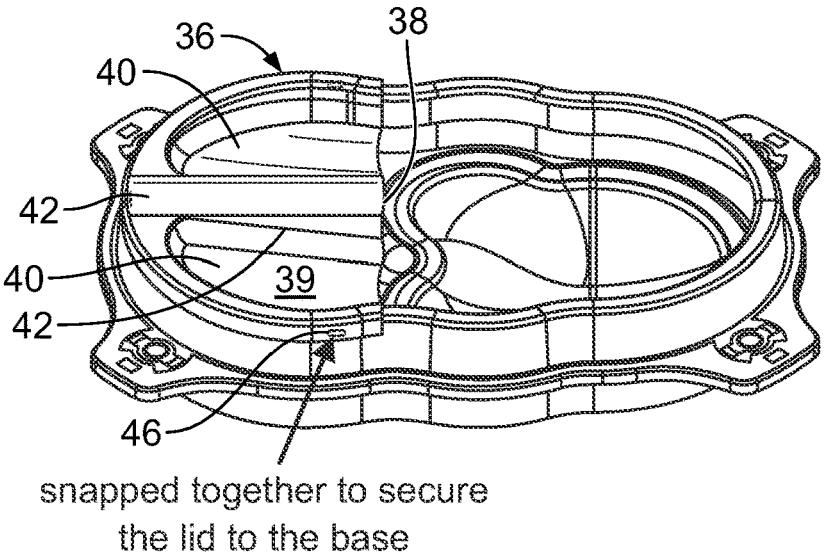

A lid 36, as seen in FIGS. 1, 3 & 4, nests with the base 14 and defines the exterior wall around the perimeter of the base. In the present described embodiment, the lid is one-piece molded plastic element which couples to the base at four corners around the base. FIGS. 7 and 8A, 8B, and 8C illustrate views for the couplings employed to secure the top layer, and lid to the base, securing therewith. Three bumps or recesses 45, 46 are shown in FIGS. 7 and 8A, 8B, and 8C which help facilitate a better fit for the couplings employed to ensure arena pieces are securely fastened, attached and snapped together to secure the lid to the base. Couplings 45, 46 as seen in FIGS. 8A, 8B, and 8C further secure the lid to the base.

Figure 5:
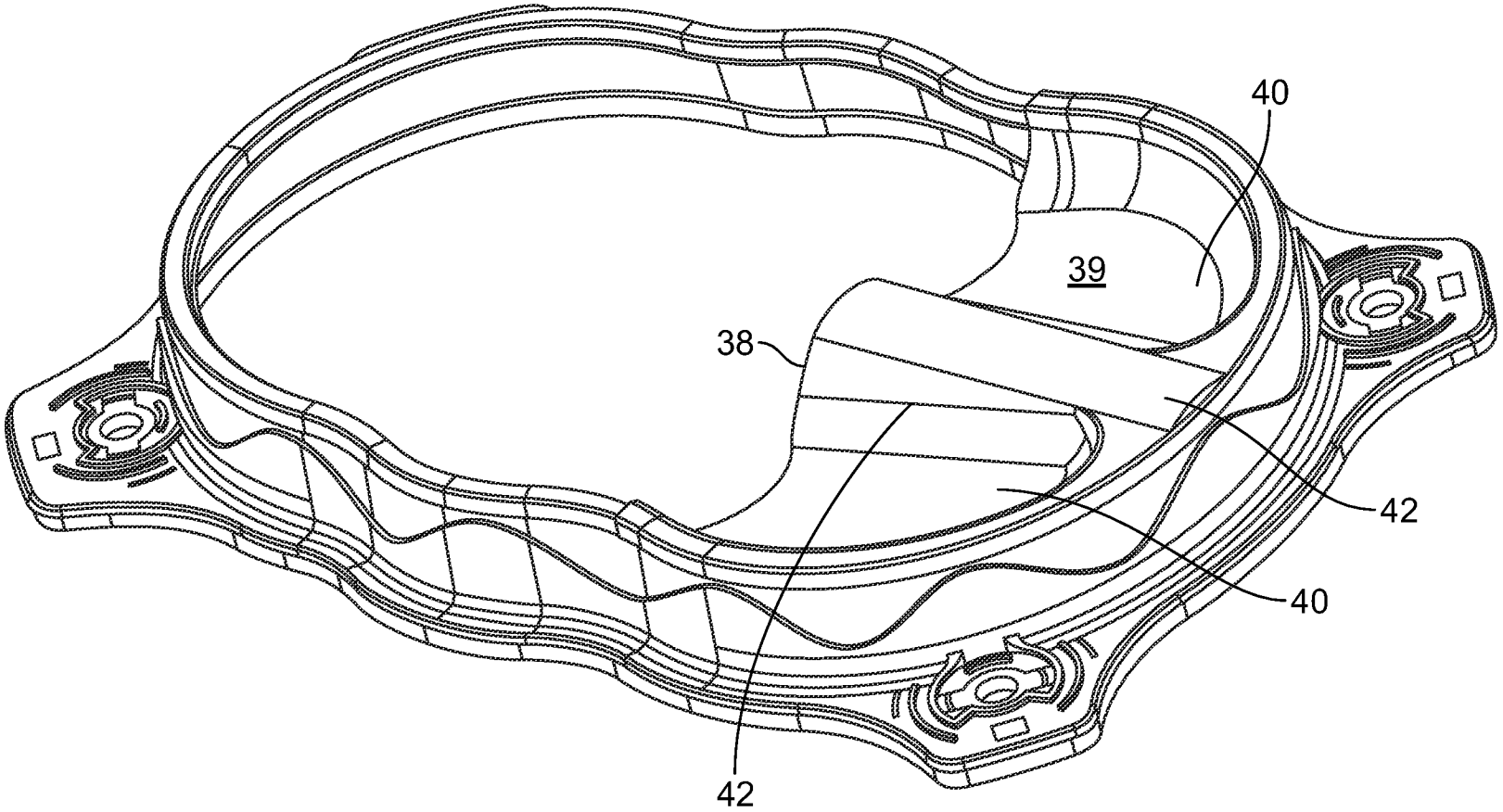
FIG. 5 is a perspective view illustrating the third level platform inserted into the lid and including a drop zone portion divided into two zones and angled toward the battling surface.

A third level platform element 38 is disposed between the base and the top of lid, creating a third play level surface 39 for directing a flow pattern of toy tops about three play levels surfaces contained within the perimeter exterior wall of the battling stadium, as seen in FIGS. 1A, 1B & 5. The third level platform element 38 is a one-piece molded plastic element which can be of the same or different durable plastic material as is used to manufacture the lid. The third level platform element 38 is easily removable from the battling stadium for alternative game play about only two play level surfaces if desired by a user.

In the present described embodiment, the third level platform element 38 includes a drop zone portion 40 angled toward the concave arena for introducing toy tops to the first play level at the battling surface from the third play level surface, as seen in FIG. 5. The drop zone portion is divided into first and second drop zone portions which are separated by a barrier wall 42. Separated first and second drop zone portions are employed to introduce two toy tops separate from one another at the third play level surface, into the first play level at the battling surface for combat. Specifically, the first and second drop zone portions align with the two symmetrical mini semi-circular portions 20 of the concave arena 16 for combat.

In use, the third level platform element 38, creating the third play level surface 39 when inserted into the battling stadium, directs interactions between toy tops that are introduced into each of the first and second drop zone portions, with wall 42 preventing the tops from interacting when at the third play surface level 39. Tops are launched onto the first play level surface from the platform element in a one-way directed flow pattern directing interactions between tops and arena surfaces to better benefit each user's experiences.

Figure 6:
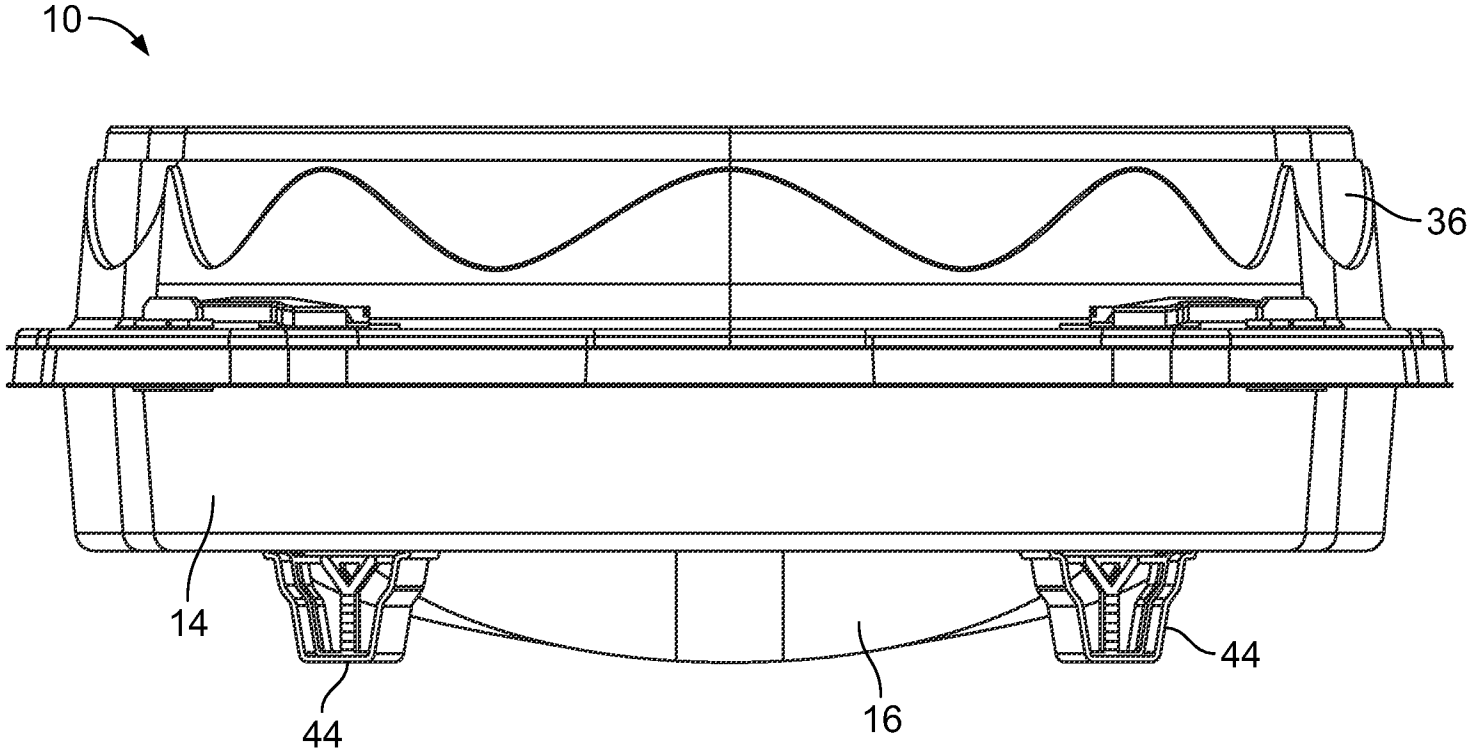
FIG. 6 is a perspective top end view of a short side of the battling stadium illustrating the connection between the lid and base with feet secured to each of four corners of the stadium.

Feet elements 44 are coupled to the base 14 for elevating the battling stadium from a supporting surface. Additionally, the feet elements raise the base up to prevent the concave arena 16, which extends below the surface of the base, from resting on the supporting surface in use, as seen in FIG. 6. The foot elements 44, and coupling elements, as seen in FIG. 8, secure the feet 44 to the base at each of the four corners for maximum stability in use.

Figure 9:
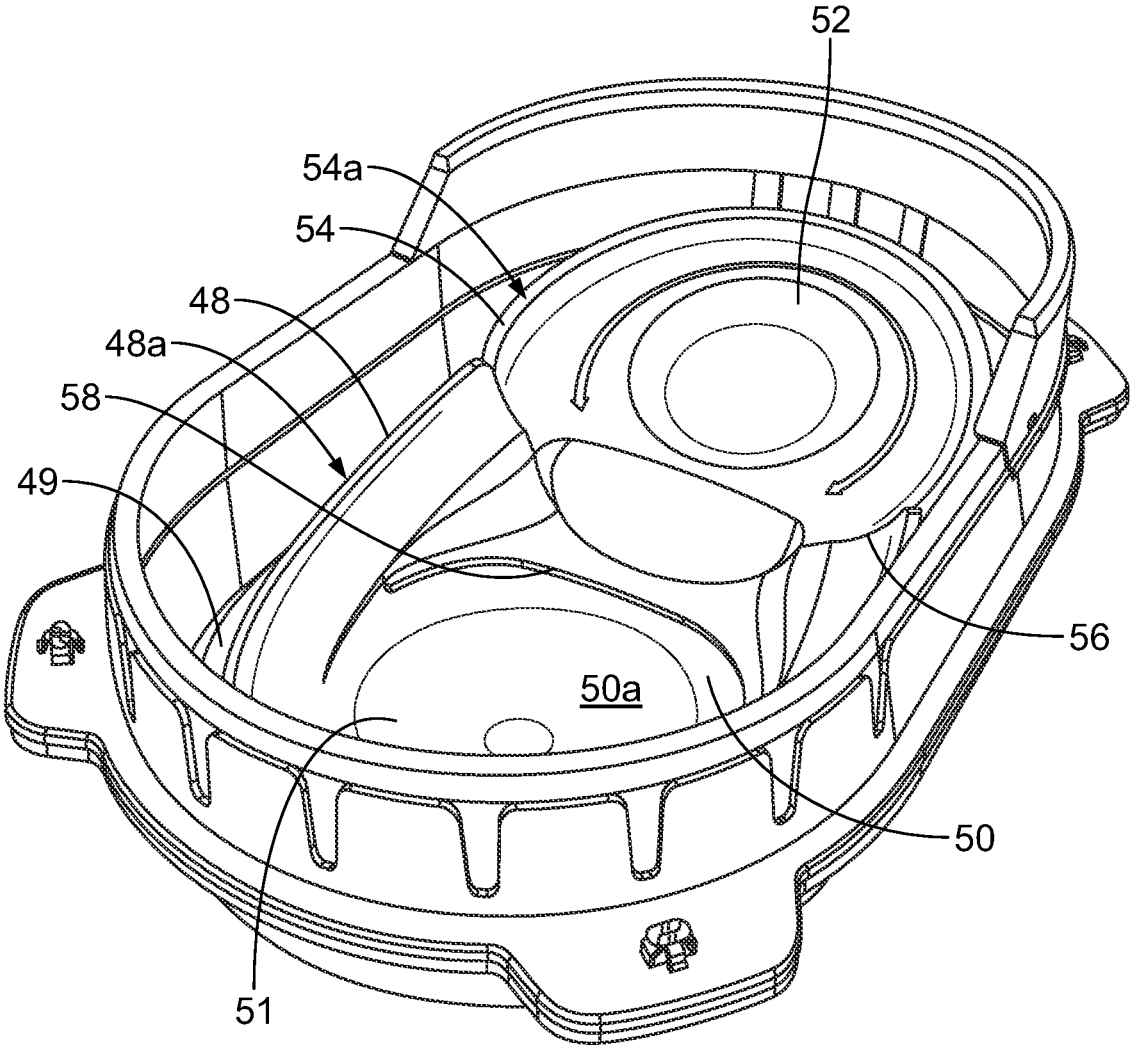
FIG. 9 is a perspective view of a further embodiment of a battling stadium game apparatus of the present invention illustrating plural and multiple play level surfaces with a third level platform including a redirection area inserted into the base of the stadium.

In a further described embodiment, the overdrive surface of the second play level surface includes an overdrive rail 48 having a riding surface 48*a* upon which spinning toy tops travel from the second play level surface to the third play level surface, as seen in FIG. 9. The overdrive rail 48, as seen in FIGS. 9 & 10, creates a second play level surface 49.

An arena 50 is disposed at a first play level 56 at a base 57, and a lid 59 nests with the base 57 defining an exterior wall around the perimeter of the base. The lid 59 is a one-piece molded plastic element which couples to the base at four corners around the base. Couplings, as seen in FIG. 7, secure the lid to the base at each corner.

Figure 10:
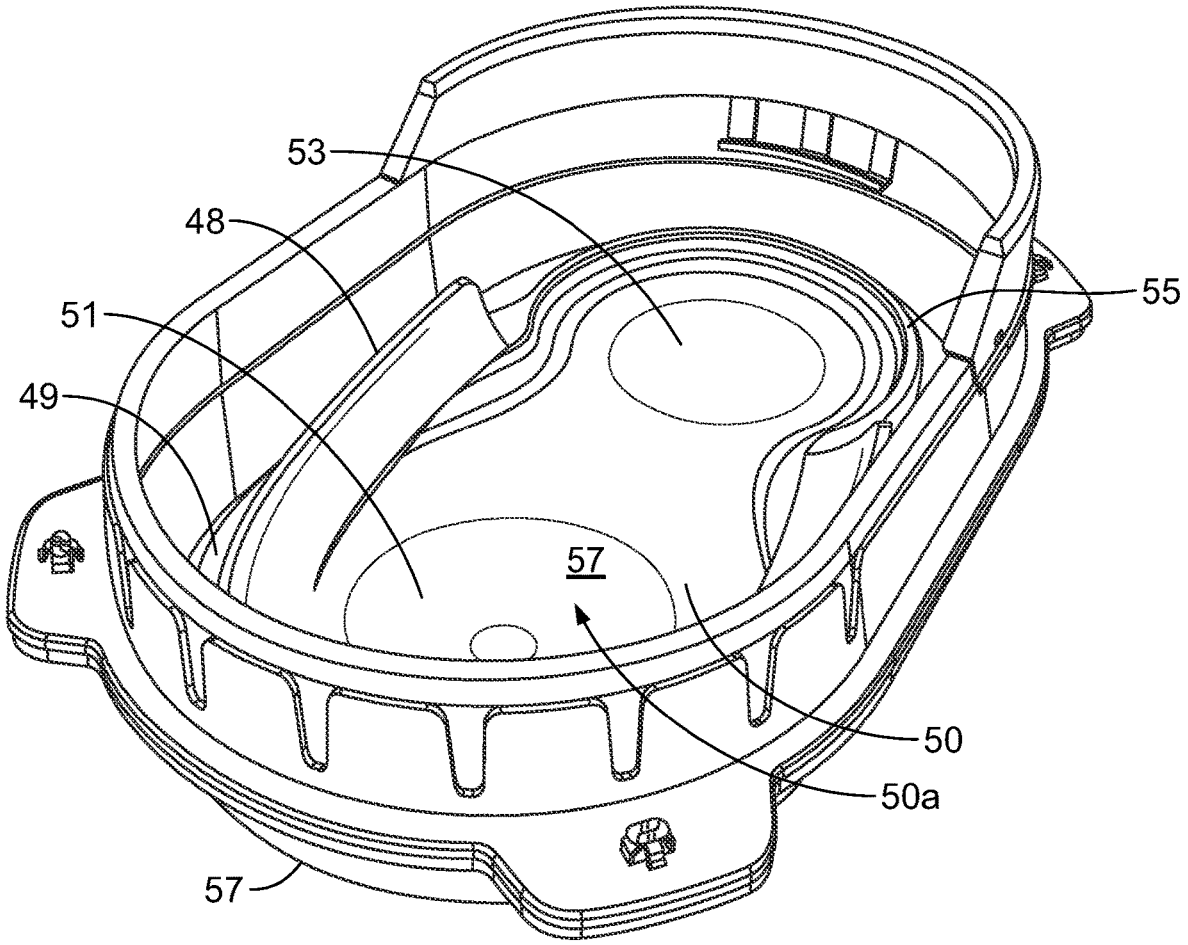
FIG. 10 is a perspective view of the battling stadium of FIG. 9 illustrating two play level surfaces as the third level platform is omitted from the stadium.

The arena 50, has a battling surface 50*a*, and includes a concave arena portion 51 and a shallow arena portion 53, as seen in FIGS. 9 & 10. A ridge 55 defines the uppermost perimeter around the arena 50, including around both the concave portion 51 and the shallow portion 53. Ridge 55 defines the uppermost point of the first play level surface 57, with the first play level surface generally including battling surface 50*a*. Spinning toy tops introduced to the first play level surface 57 can freely travel between the concave portion 51 and the shallow portion 53 of the arena 50 in a random fashion to engage each other in combat at the first play level surface.

The overdrive rail 48 is disposed at the second play level surface 49 at the base, as seen in FIGS. 9 & 10. The overdrive rail protrudes out from the concave arena portion 51 and the overdrive rail 48 and overdrive surface 48*a* are disposed at a level elevated from the concave arena portion creating the second play level surface 49.

A third level platform element 56 is inserted between the base and the lid creating a third play level surface for directing a flow pattern of toy tops about multiple play level surfaces contained within the perimeter exterior wall of the battling stadium, as seen in FIG. 9. The third level platform element 56 is a one-piece molded plastic element made of a durable plastic material. The third level platform element 56 is easily removable from the battling stadium for alternative game play about only one first play level surface, as described above, if desired by a user.

The third level platform element 56 nests with the arena 50 mainly at the shallow portion 53 of the arena and partially into the concave portion 51 of the arena creating a smooth transition between multiple play level surfaces. The third level platform element 56 includes a redirection area 52 and a platform rail 54 outside a periphery of the redirection area, as seen in FIG. 9. The redirection area and platform rail are disposed at a first end of the platform element 56, and a ramped ledge 58 is disposed at a second end of the platform element. The third level platform element 56 inserts into the base of the stadium by coupling to ridge 55 at the uppermost point of the arena 50. The platform element also seamlessly nests with the arena at the concave portion 51 of the first play level surface and with the overdrive rail and surface of the second play level surface creating directional play and a directed one-way flow pattern to actively direct interactions of spinning tops hopping and traveling between multiple play level surfaces.

The third level platform element 56 inserts into the base of the stadium adjacent the arena 50 and is angled toward the battling surface 50*a*. The ramped ledge 58 of the platform element seamlessly nests with, and is angled toward, the concave portion 51 of the arena creating a smooth riding surface between the battling surface 50*a* and the ramped ledge 58 such that spinning tops smoothly travel from the battling surface 50*a* of the concave portion up onto the ramped ledge 58 of the platform.

Additionally, the platform rail 54 nests with the overdrive rail 48, at both sides of the concave portion 51 of the arena, with the platform rail seamlessly butting up to the overdrive rail when the third level platform element is inserted into the stadium, as seen in FIG. 9. A riding surface of the platform rail 54*a* is disposed along a top of the platform rail and merges seamlessly with the riding surface 48*a* of the overdrive rail creating a smooth continuous riding surface for spinning toy tops to transition smoothly, and at a high velocity, from the overdrive rail at the second play level surface up to the platform rail at the third play level surface.

The redirection area 52 of the platform element 56, as seen in FIG. 9, is generally a shallow concave mini arena carved into the third level platform element and extending downward to ledge 58 for redirecting spinning tops from the third play level surface to the battling surface 50*a* at the first play level surface and/or the overdrive rail at the second play level surface creating directional play and flow patterns to actively direct interactions of spinning tops hopping and traveling between multiple play level surfaces.

The third platform element 56, as seen in FIG. 9, creates a hopping arena play function when inserted into the stadium with spinning toy tops traveling, jumping and hopping between multiply play level surfaces. For example, spinning toy tops introduced into the first level play surface at the concave arena portion 51 can travel along the overdrive rail 48 of the second play level surface up to the platform element of the third play level surface and/or travel up the ramped ledge 58 to the third level play surface in an alternative flow pattern hopping from the first play level surface directly to the third play level surface. Spinning toy tops at the redirection area 52 at the third play level surface can be redirected back to the overdrive rail 48 at the second play level surface and then travel to the battling surface 50*a* at the first play level surface and/or be redirected to the battling surface at the first play level surface in an alternative flow pattern hopping from the third play level surface directly to the first play level surface.

In a further described embodiment, one or more spinning toy tops are in combination with the battle arena game apparatus 10. The one or more spinning tops can be launched into the concave arena 16 rotationally spinning in either a clockwise or counter clockwise direction and travel toward the right or left, accordingly, as dictated by a rotational spin of each top.

The one or more spinning toy tops each has an elongated tip with a partially flat riding tip surface for gliding along the three play level surfaces. The one or more tops further include an outer tip surface for engaging the overdrive rail and platform rail. The tip of each spinning top tilts to a point when the widest part of the tip hits either rail. Additionally, the spinning tops accelerate slightly when the tip hits the overdrive rail or the platform rail creating directional play and flow patterns to actively direct interactions of spinning tops hopping and traveling between multiple play level surfaces.

The elongated tip is of the one or more toy tops is of a length suitable to smoothly ride along the overdrive and platform rails while keeping an upper portion of the top from contacting the rails and interfering with the smooth travel of the one or more spinning tops through the second and third play level surfaces. The tip length allows the one or more tops to ride up on a banked surface or slope of the overdrive rail or platform rail and run along the rails at a fast rate of speed so that the one or more spinning tops can ascend the merged rails as described herein and below, to reach the third play level surface at a quick velocity without being slowed down so as to be launched back onto the battling surface 50*a* at a quick velocity.

Figure 11:
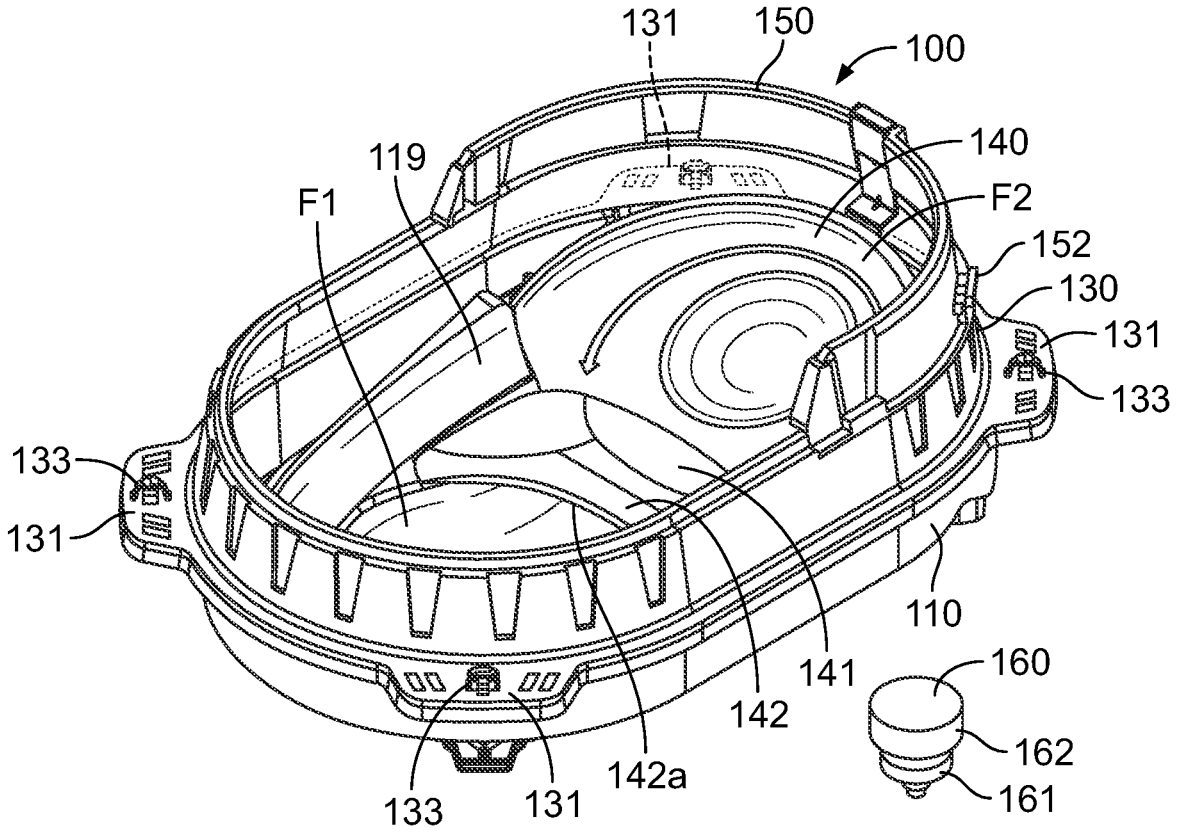
FIG. 11 is a perspective view showing a second embodiment example of a use mode of a stadium arena.
Figure 12:
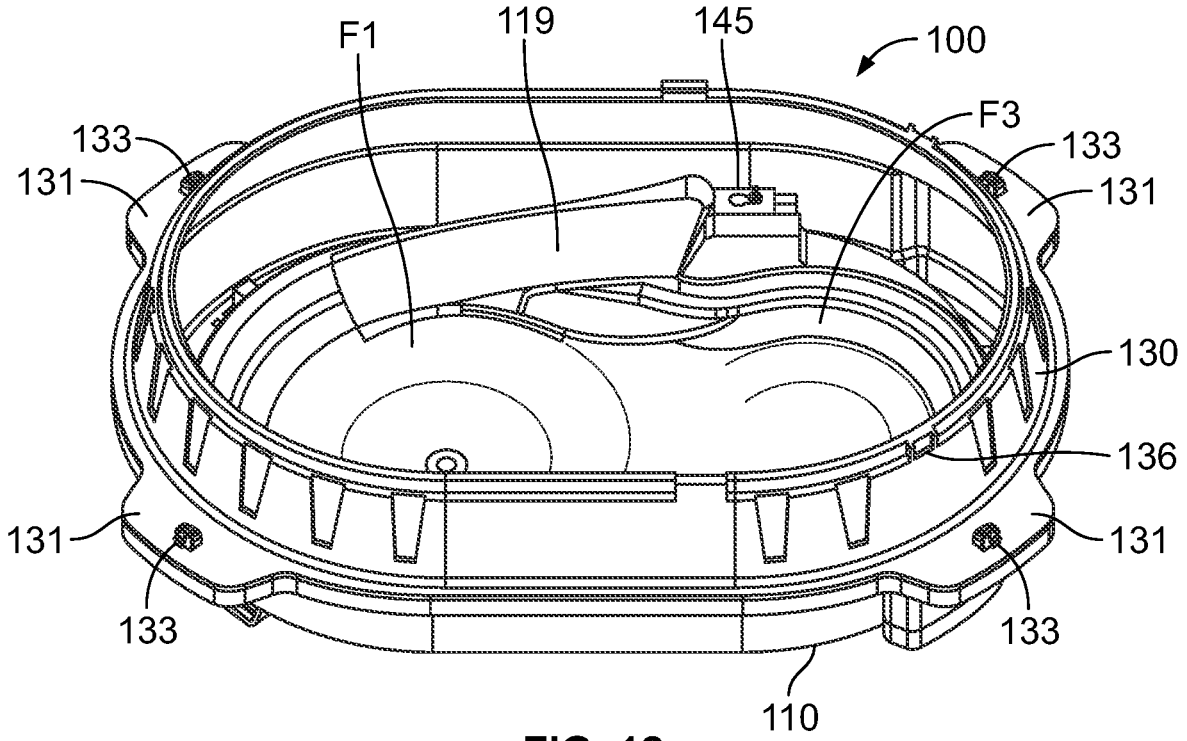
FIG. 12 is a perspective view showing another example of a usage mode of the stadium of the second embodiment.

FIG. 11 is a perspective view showing an example of a use mode of the stadium 100 of the a second embodiment example of a use mode of a stadium arenas, and FIG. 12 is a perspective view showing another example of a use mode of the stadium 100 of the second embodiment. The stadium 100 of the present embodiment is configured such that the fence 130, the second face member 140, and the auxiliary fence 150 can be attached to and detached from the base 110 which is oval in plan view.

In the stadium 100, when the fence 130, the second face member 140, and the auxiliary fence 150 are attached to the base 110 (FIG. 11), the tops battle each other using the first field F1 and the second field F2. Further, in a state where only the fence 130 is attached to the base 110 without attaching the second face member 140 and the auxiliary fence 150 to the base 110 (FIG. 12), the top is formed using the first field F1 and the third field F3. You can battle each other.

Figure 13:
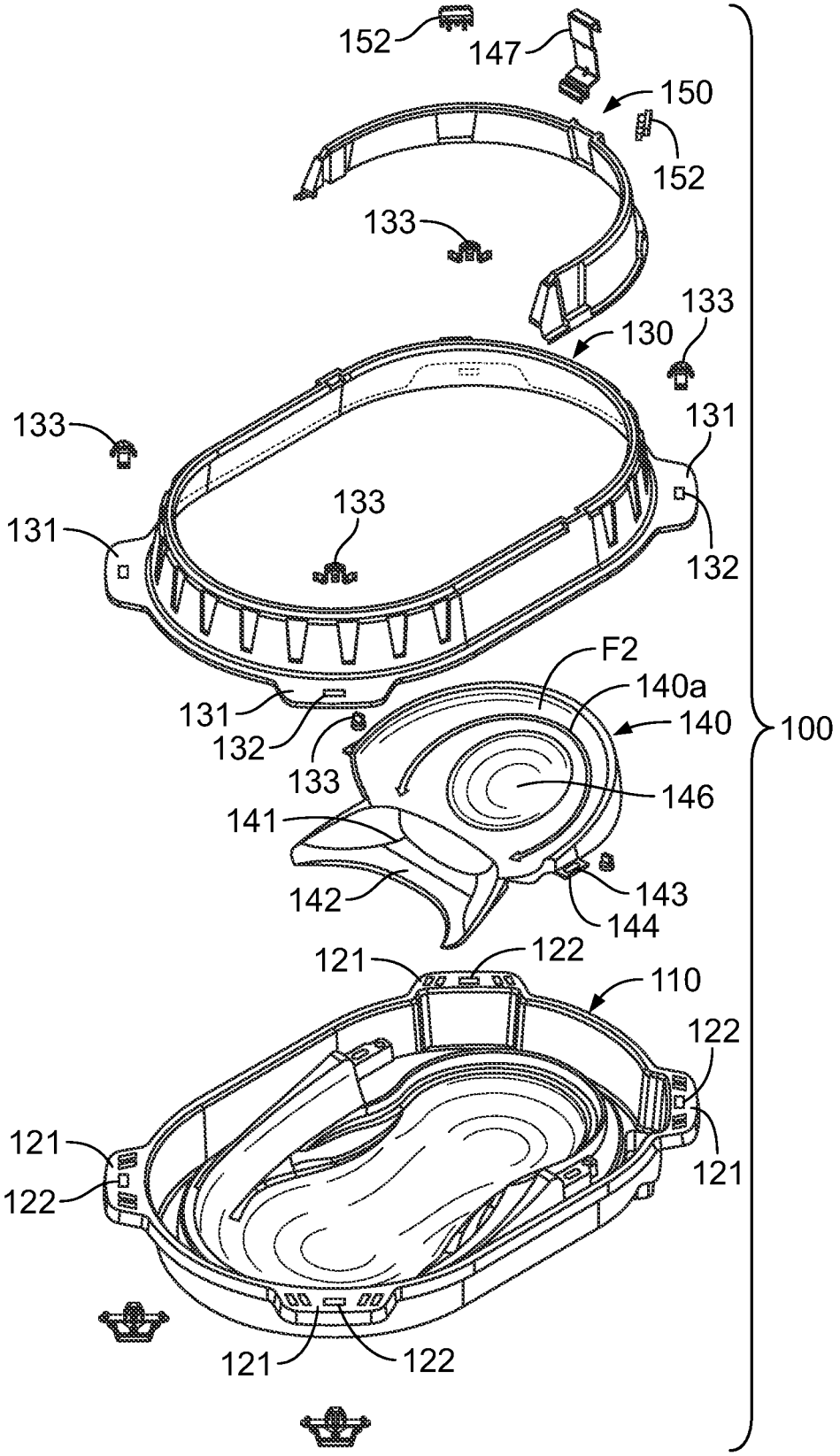
FIG. 13 is an exploded perspective view of a stadium.
Figure 14:
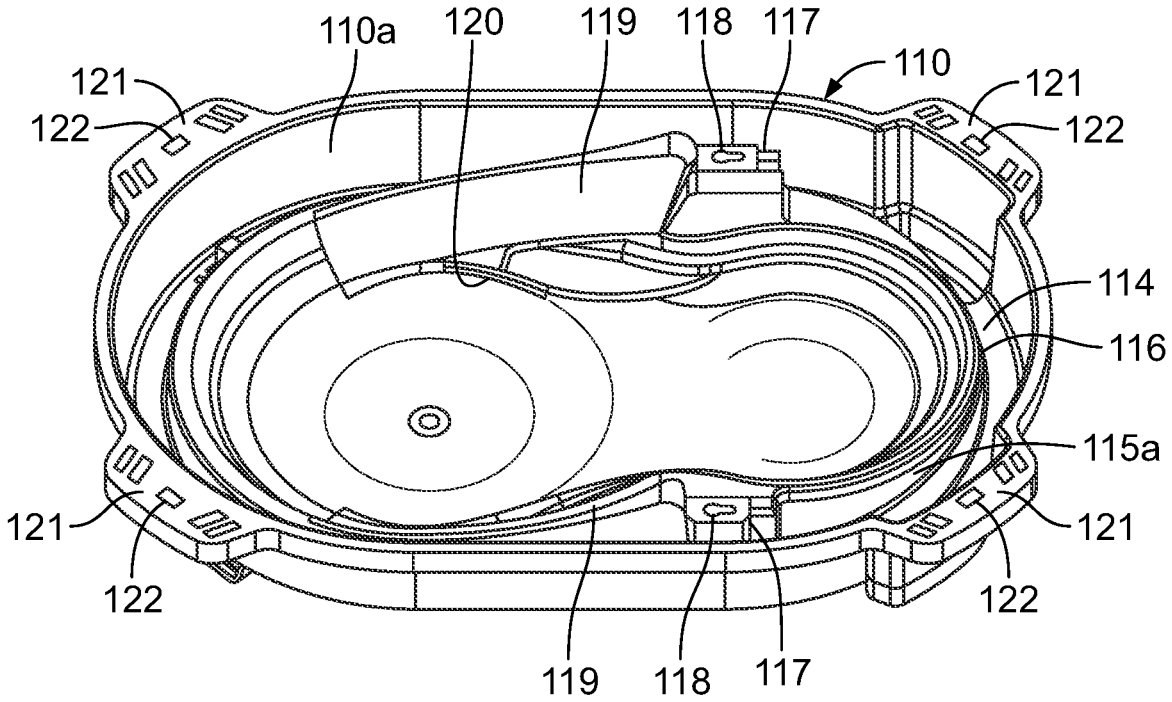
FIG. 14 is a perspective view of a base.

FIG. 13 is an exploded perspective view of the stadium 100, FIG. 14 is a perspective view of the base 110, with the upper surface of the base 110 has a concave portion 110*a* in which the inner portion of the outer edge is largely depressed. The bottom plate 111 of the concave portion 110*a* includes a first face material portion 112 forming a first field F1, and a third face material portion 113 forming a third field F3. Each of the first field F1 and the third field F3 is formed in a substantially circular shape in plan view, and the first field F1 and the third field F3 are connected to each other in a plane. As a result, when performing the battle with the first field F1 and the third field F3 as one field, the top 160 runs around and can move between the first field F1 and the third field F3.

Figure 15:
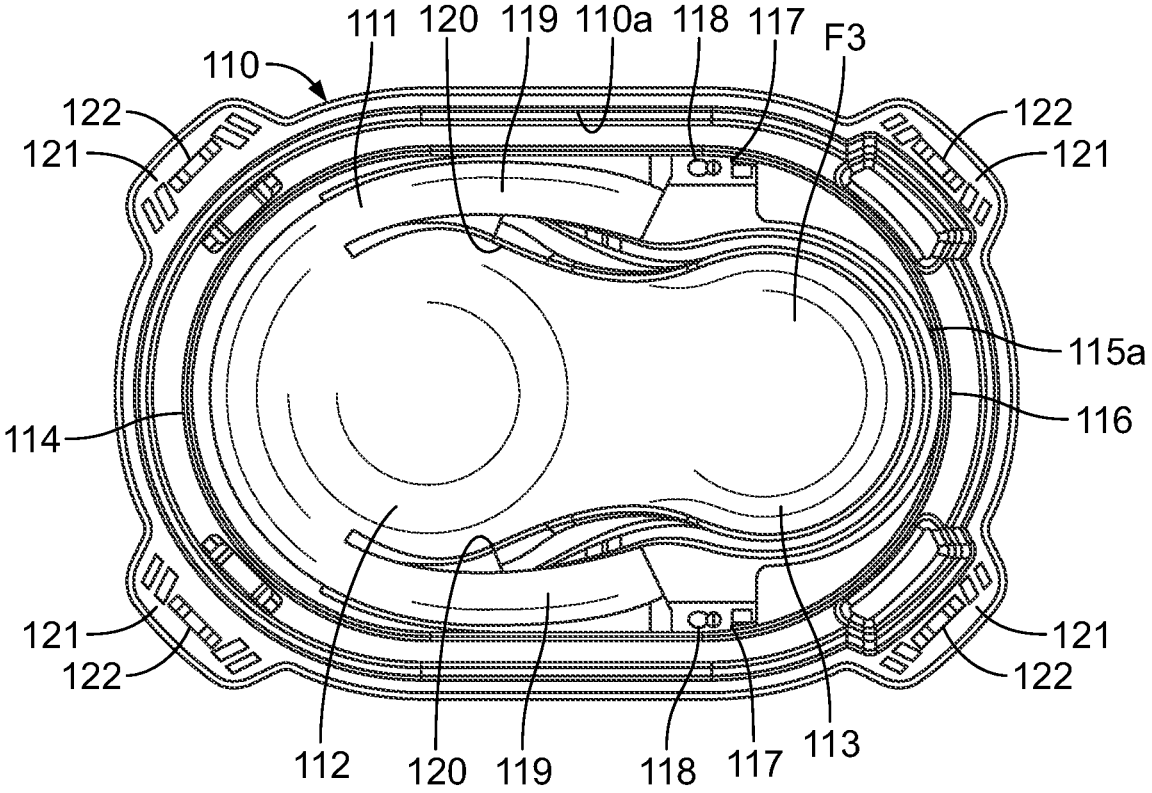
FIG. 15 is a plan view of a base.

As shown in FIGS. 14 and 15, a groove 114 is formed just inside the outer edge of the base 110 and extends over the entire outer edge. The groove 114 functions to capture the top 160 that has been flipped out of the first field F1 and the third field F3 due to the battle between the tops. At the time of capture, the body 62 of the top 160 is fitted in the groove 114. This prevents the top 160 captured by the groove 114 from returning to the first field F1 or the third field F3. However, the groove 14 is not limited to this, and the groove 114 may be configured so that the entire top 160 is fitted into the groove 114 when captured.

A first field F1 and a third field F3 are defined by an inner wall (inner peripheral wall) 115*a* of the groove 14. In the present embodiment, each of the first field F1 and the third field F3 is formed in a mortar shape so as not to hinder the traffic of the top 160 between the first field F1 and the third field F3. The inner peripheral wall 115*a* on the third field F3 side is formed in a semicircular arc shape in a plan view, and surrounds the third field F3 from three sides except the first field F1 side. The inner peripheral wall 15*a* of the third field F3 side, both end portions of the first field F1 side first field F1 is formed so as to gradually become wider toward the center. On the inner peripheral wall 115*a*, a convex ridge 116 extending along the inner peripheral wall 115*a* and having a semicircular arc shape in plan view, and a step-like mounting portion 117 for mounting a second face member 140 described later are provided. Is formed. The mounting portion 117 has a mounting hole 118 formed therein.

On the other hand, the inner peripheral wall 115*a* on the first face material portion 112 side is formed in a U-shape in plan view, and both ends reach the mounting portion 117, and surround the first field F1 from three sides except the third field F3 side. A strip-shaped slope 119 is formed on the first face material portion 112 so that the top 160 runs up from the first field F1 toward the third field F3. Slope 119 extends in a substantially tangential direction of the first field F1, the inner peripheral wall 15*a* of the first field F1 and third field F3 extends to a point of mounting portion 117 so as to be gradually higher. This slope 119 cant of the third field F3 may preferably be set to gradually tightly toward the side. That is, the slope 119 is preferably formed so as to be inclined so that the outside is higher than the inside in the width direction, and the inclination is preferably increased toward the upper end of the slope 119.

Also, as shown in FIG. 15, the upper end of the slope 119 is curved inward in a plan view so that the run-up top 160 can jump and land at the center of a second field F2 described later. Thus, the orientation of the upper portion of the slope 119, ran up coma 160 need only be set to point to the center of the second field F2, necessarily, it may plan even if it is not bent inward in plan view It may be linear in view.

One slope 119 having such a configuration is provided on each side in the direction orthogonal to the direction in which the first field F1 and the third field F3 are arranged. The reason why the slopes 119 are provided on both sides is that the top 160 runs up the slope 119 according to the direction of revolving and rolling associated with the rotation of the top 160, so that even if the tops have different rotation directions, the tops of either slope 119 can be used for upwardly directed movement due to the slope. This slope 119 can be used even when a battle is performed using the first field F1 and the third field F3. That is, since the top runs up the slope 119 and falls from the hill to the third field F3, it can be used to attack the opponent's top 160 on the third field F3 from above. In FIG. 15, reference numeral 120 indicates a step. Further, each of the four corners of the base 110 is formed with one trapezoidal projecting portion 121 projecting outward. The overhang 121 is formed in a shape and size that can be held by hand from below. Further, each overhanging portion 121 is formed with a mounting hole 122 for mounting the fence 130.

As shown in FIG. 11, the fence 130 is erected on the outer edge of the base 110. The fence 130 has substantially the same shape as the outer edge in plan view so as to be erected over the entire periphery of the outer edge of the base 110. The fence 130 in this case may be configured so that it can be disassembled into several pieces in the circumferential direction, but in that case, attachment and detachment becomes complicated and strength is reduced. The fence 130 is inclined such that the upper end is on the inner side than the lower end. As a result, jumping out of tops from the first field F1 and the third field F3 can be effectively prevented.

The four corners of the fence 130 are provided with trapezoidal overhangs 131 that overlap the overhangs 121. An attachment hole 132 is also formed in the overhang portion 131. When attaching the fence 130 to the base 110, the fence 130 is placed on the outer edge of the base 110 so that the overhang portion 121 and the overhang portion 131 are overlapped, and the overhang portion 121 and the overhang portion 131 are placed in the attachment holes 122 and the attachment holes 132. The fitting 133 is fitted. The attachment of the fence 130 to the base 110 may be performed by a known method, for example, by fitting unevenness or screwing. Therefore, detailed description is omitted.

The fence 130 has a mounting hole 136 (FIG. 12) for mounting an auxiliary fence 150 described herein. As shown in FIGS. 11 and 13, a second field F2, a cliff 141, and a transition portion 142 are formed in the second face material portion 140. The second field F2 is formed at a position higher than the transition portion 142 with the cliff 141 interposed therebetween.

The second face member 140 is configured to be detachable from the base 110. That is, the second face member 140 is provided with the rectangular projecting portion 43 at a position corresponding to the mounting portion 117. A mounting hole 144 is formed in the overhang portion 143. Then, in order to attach the second face member 140 to the base 110, the second face member 140 is placed on the base 110 so that the attachment portion 117 and the overhang portion 43 are overlapped, and the attachment hole 18 and the attachment hole are attached. A fitting 145 is fitted to 144. The attachment of the second face member 140 to the base 110 may be performed by a known method, for example, by fitting unevenness or screwing. Therefore, detailed description is omitted.

The second field F2 is formed by a concave portion 140*a* defined by the outer edge of the second face member 140. The bottom surface of the concave portion 140*a* is substantially flat except for a concave portion 146 to be described later. When the second face member 140 is mounted on the base 110, the bottom surface of the concave portion 140*a* has a downward slope toward the first field F1. Further, a mortar-shaped concave portion 146 is formed at the center of the second field F2. By making the top easily stay in the concave portion 146 by the concave portion 146, the possibility of a battle in the concave portion 146 is increased. The cliff 141 is provided at an end of the second field F2 on the first field F1 side as shown in FIG. 11. The cliff 141 functions to drop the top 160 from the second field F2 to the first field F1.

The upper surface of the transition part 142 has a slight downward slope from the cliff 141 toward the first field F1 when the second face material part 140 is attached to the base 110, and the tip of the transition part 142 is the first. It is located slightly higher than the floor of the field F1. That is, the tip of the transition section 142 is arc-shaped and has a small step with the floor of the first field F1. The step 142*a* (FIG. 11) prevents the top from approaching the cliff 141, and prevents the body of the top 160 from colliding with the cliff 141.

Figure 16:
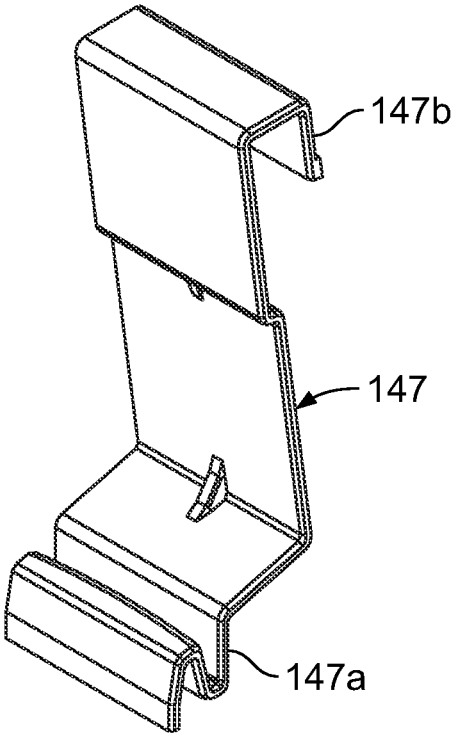
FIG. 16 is a perspective view of a suspension component.
Figure 17:
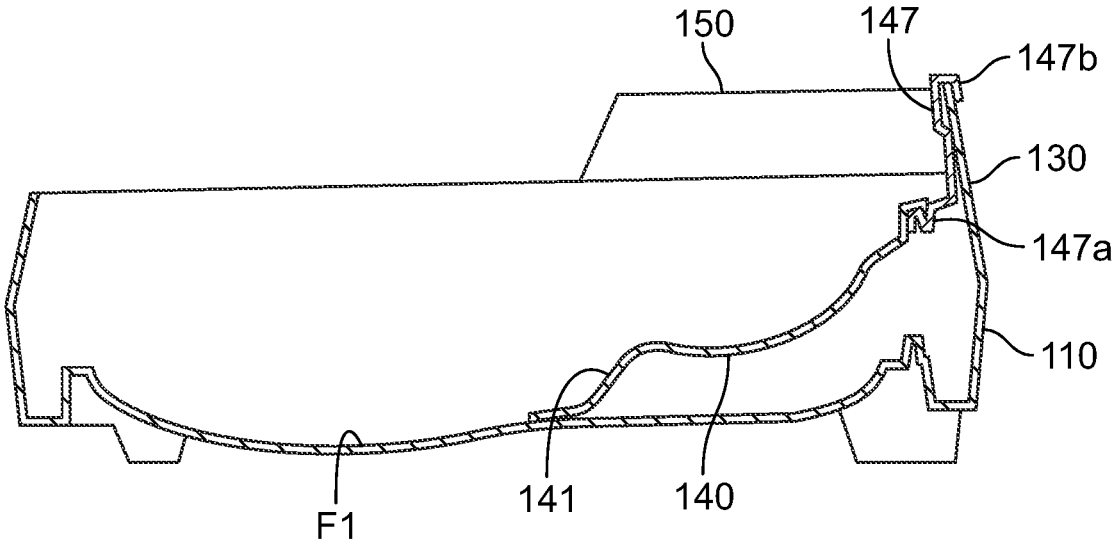
FIG. 17 is a side elevational cross-sectional view of the stadium of FIG. 11.

As described above, one end of the second face member 140 is fixed to the second face member 140 by the attachment 145 as described above, and the other end of the second face member 140 is suspended by the hanging part 147 (FIG. 16), auxiliary fence as suspended in fence 150. That is, hooks 147*a* and 147*b* that are opposite to each other are formed at both ends of the suspension component 147, the lower hook 147*a* is hooked below the second face member 140, and the upper hook 147*b* is placed above the auxiliary fence 150. The other end of the second face member 140 is suspended from the auxiliary fence 150 by the suspension component 147. With such a structure, the thickness of the second face member 140 can be reduced. In the case where the thickness of the second face member 140 does not matter, the second face member 140 may be fixed by the same method as that of fixing the one end side without using the suspension part 147.

The auxiliary fence (second fence) 150 is used when the second face member 140 is attached to the base 110 for use. Auxiliary fence 150 is the first field F1 and has a semicircular shape when viewed from the top so that it can from the three sides except the side covering the second field F2. Like the fence 130, the auxiliary fence 150 is inclined such that the upper end is located inside the lower end. As a result, jumping out of the top from the second field F2 can be effectively prevented.

The auxiliary fence 150 has a mounting hole 151 for mounting the auxiliary fence 150. To attach the auxiliary fence 150 to the fence 130, the auxiliary fence 150 is placed on the fence 130 such that the mounting hole 36 and the mounting hole 151 are overlapped, and the mounting tool is mounted on the mounting hole 36 and the mounting hole 151, 152 (FIG. 11) are fitted. The attachment of the auxiliary fence 150 to the fence 130 may be performed by a known method, for example, by fitting unevenness or screwing. Therefore, detailed description is omitted. The top 160 includes a shaft 161 and a body 162. The shaft 161 is formed in an inverted conical shape from the body 162 toward the tip of the shaft 161. In the present embodiment, the diameter of the shaft portion 161 is gradually increased from the tip of the shaft portion 161 toward the body 162, but may be gradually increased from the tip of the shaft portion 161 toward the body 162.

Figure 18:
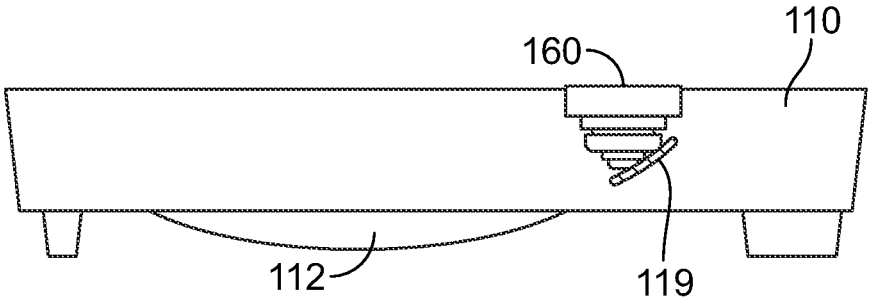
FIG. 18 is a diagram showing an engagement relationship between a ramp in the middle of the slope and the slope.
Figure 19:
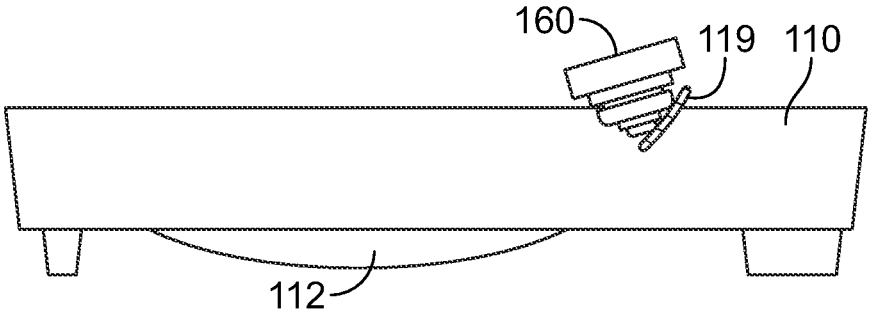
FIG. 19 is a view showing an engagement relationship between a ramp at the upper end of the slope and the slope.

As described above, since the shaft 61 is formed in an inverted conical shape and the cant of the slope 119 is directed toward the hill, the outer periphery of the shaft 61 of the top running around the first field F1 is subjected to centrifugal force. As a result, when the vehicle is pressed against the slope 119 and rolls, the speed is increased and the vehicle runs up the slope 119. When playing in the first field F1 and the second field F2, the second face member 140 is attached to the base 110, and the fence 130 and the auxiliary fence 150 are attached (FIG. 11). Then, a user may shoot multiple tops toward the field. In this case, a plurality of tops may be released in one of the first field F1 and the second field F2, or a plurality of tops may be released in the first field F1 and the second field F2. Then, the top 160 released to the field runs around in the field, the top 160 of the first field F1 runs up the slope 119, and the top of the second field F2 falls from the cliff 141 to the first field F1, thereby a battle can be caused in the first field F1 and the second field F2. Further, when the top 160 falls from the cliff 41 of the second field F2 to the first field F1, the top 160 in the first field F1 can be attacked from above. FIGS. 18 and 19 show that the top 160 of the first field F1 runs up the slope 119. FIG. 18 shows a state where the top 160 is located in the middle of the slope 119, and FIG. 19 shows a state where the top 160 is located at the upper end of the slope 119. The top 160 runs around in the direction opposite to the rotation direction. As a result, the slope 119 rolls while the outer periphery of the shaft portion 61 of the top 160 is pressed against the slope 119 by centrifugal force. In this case, since the slope 119 is provided with a cant, the top 160 runs up the slope 119. That is, since the cant of the slope 119 becomes harder when going upward, the upper portion of the outer periphery of the shaft portion 161 of the top 160 comes into contact with the slope 119, and the top 160 runs up the slope 119 while increasing the speed. Then, when reaching the slope 119, the top 160 jumps toward the recess 146 because the direction of the slope 119 is above the recess 146. Thereby, the top 160 falls into the concave portion 146.

When playing in the first field F1 and the third field F3, in this case only the fence 130 is attached to the base 110. Then, a plurality of tops 160 are released. In this case, the first field F1 may be off a plurality of tops to one or third field F3, the first field F1 may be off a plurality of tops in a divided third field F3. Then, the top 160 on goal in fields, or running around in the field, the first field F1 from or moved to the third field F3, or moved from the third field F3 in the first field F1. Accordingly, the first field F1 can be a battle and third field F3. The first field F1 up top 160 of up the slopes 119, falls into the third field F3. Thus, the opponent's top 160 in the third field F3 can be attacked from above.

Figure 20:
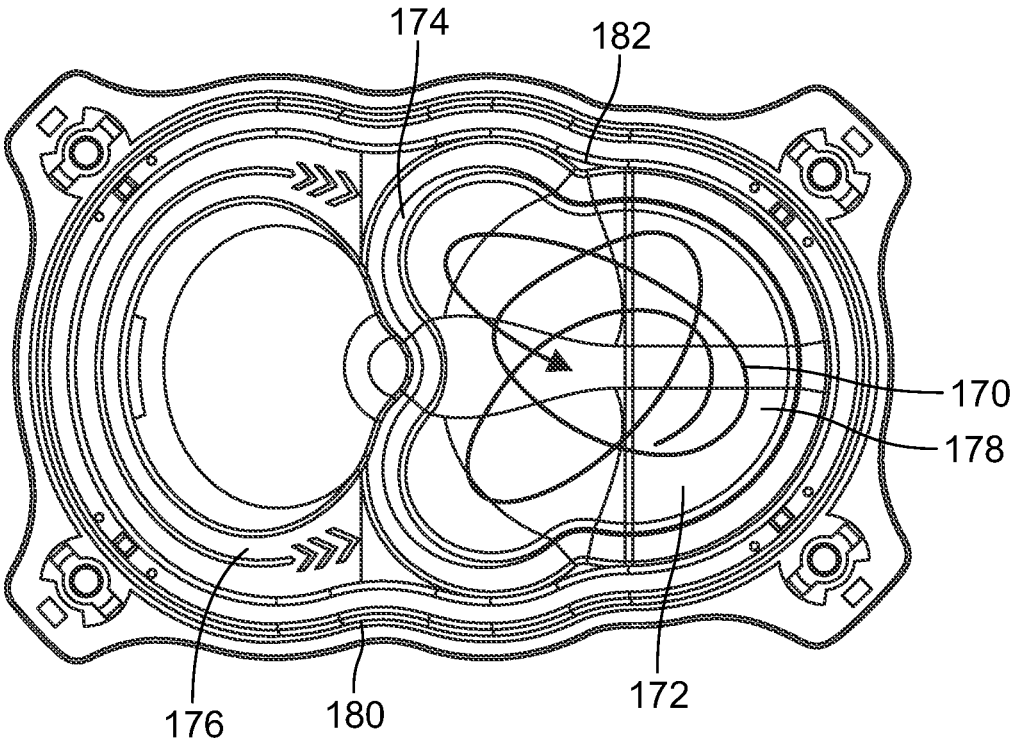
FIGS. 20 through 26 illustrate a top toy path within the first embodiment arena showing potential top run trajectory therein as travel might proceed as between lower and upper bowls.
Figure 21:
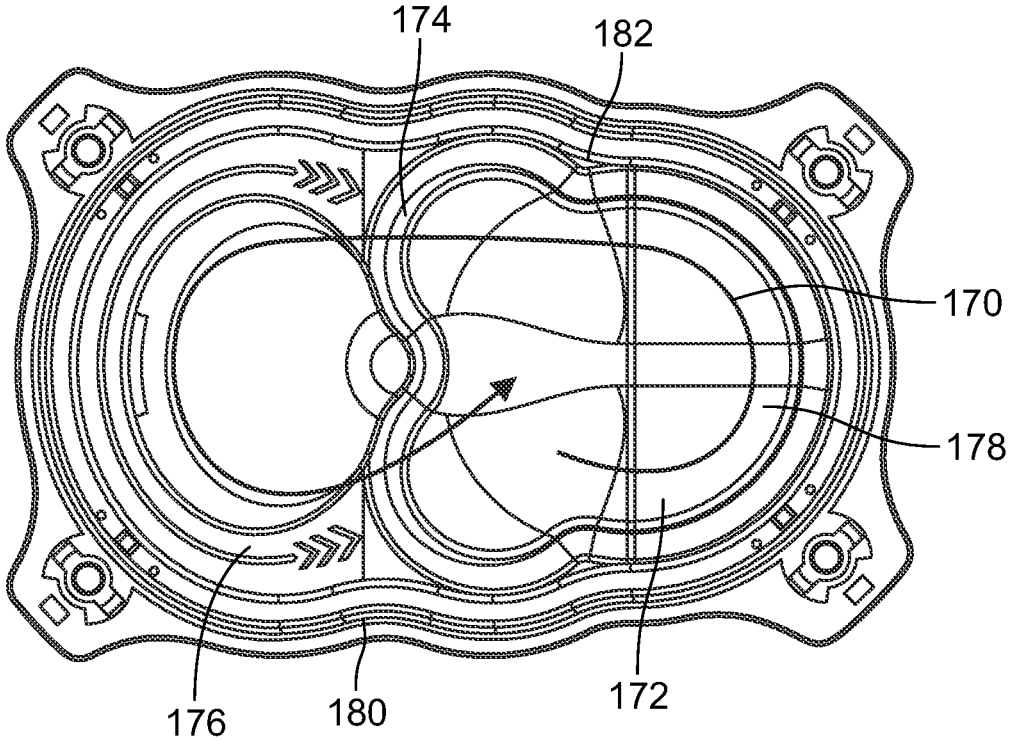

FIG. 20 illustrates a top toy path 170 within the first embodiment arena showing potential top run trajectory therein, where the irregular shaped lower bowl 172 which helps contain the top's energy. FIG. 21 illustrates a top toy path 170 within the first embodiment arena showing potential top run trajectory therein as travel might proceed from the lower to the upper bowl. Larger radii 174 herein encourages the top to enter the upper bowl. The geometry 178 helps accelerate top toward the upper bowl. Geometry 176 of the upper bowl guide the tops toward the middle portion of the lower bowl.

Figure 22:
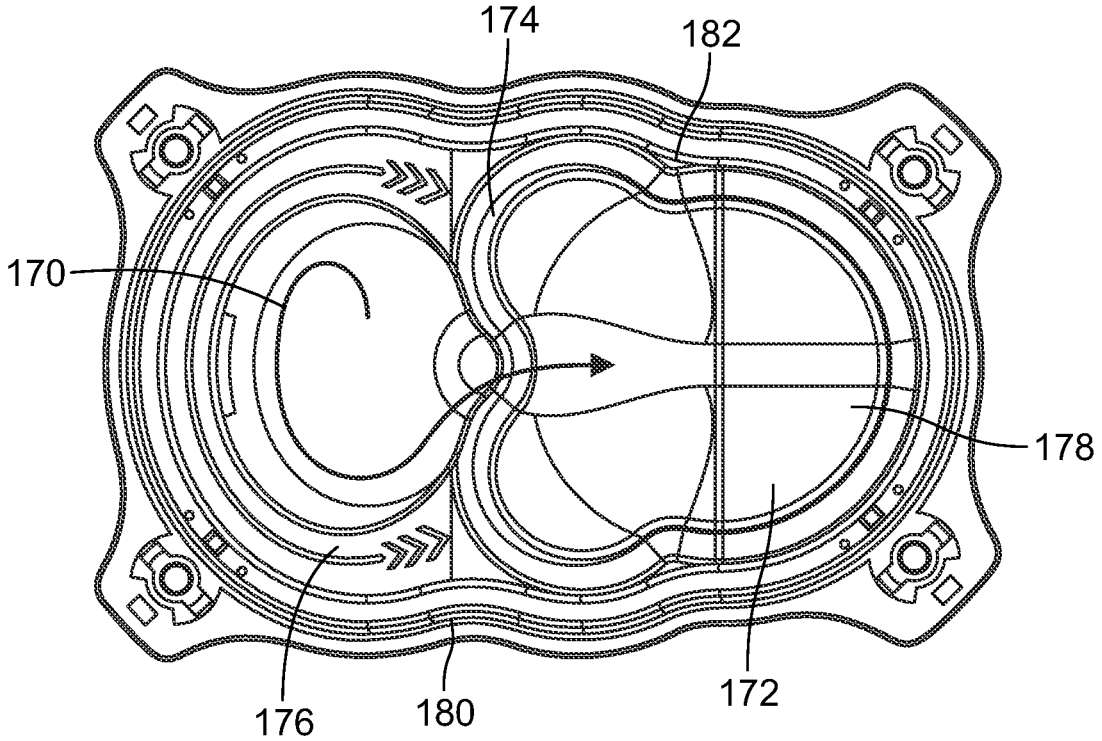
Figure 23:
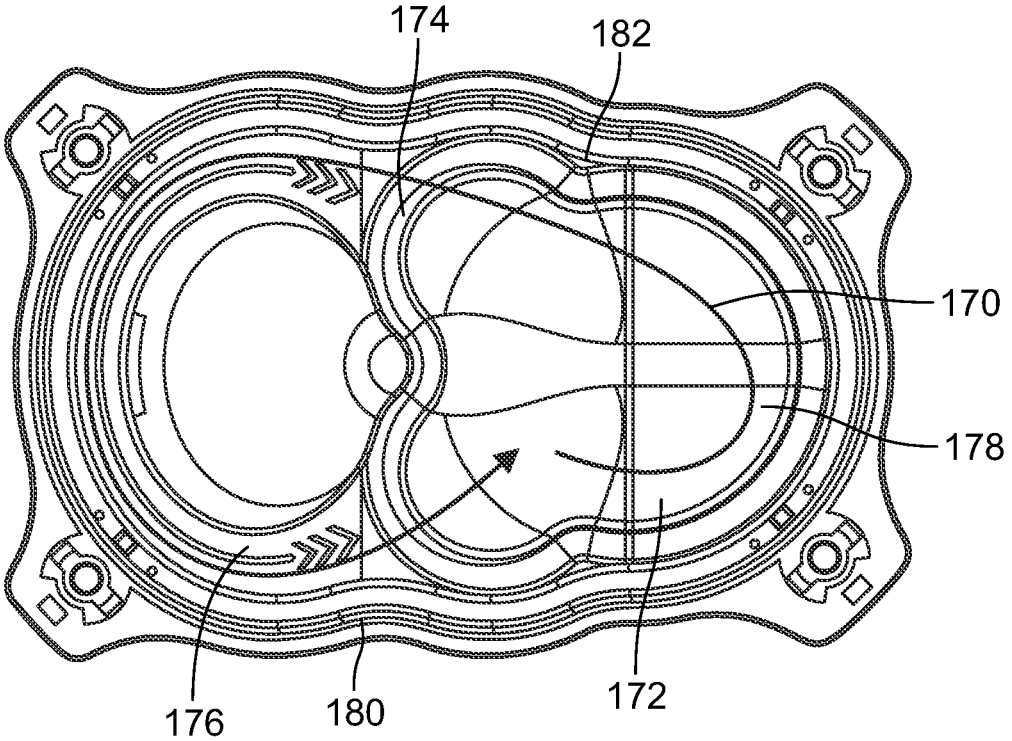

FIG. 22 illustrates a top toy path within the first embodiment arena showing potential top run trajectory therein as travel might proceed within the upper bowl. FIG. 23 illustrates a top toy path within the first embodiment arena showing potential top run trajectory as travel might proceeds from the lower bowl and then along the upper bowl's platform. Housing wall shape contour 180 guides the top back toward the lower bowl. Generally, the arena's geometry encourage top to top collisions by guiding them toward each other.

Figure 24:
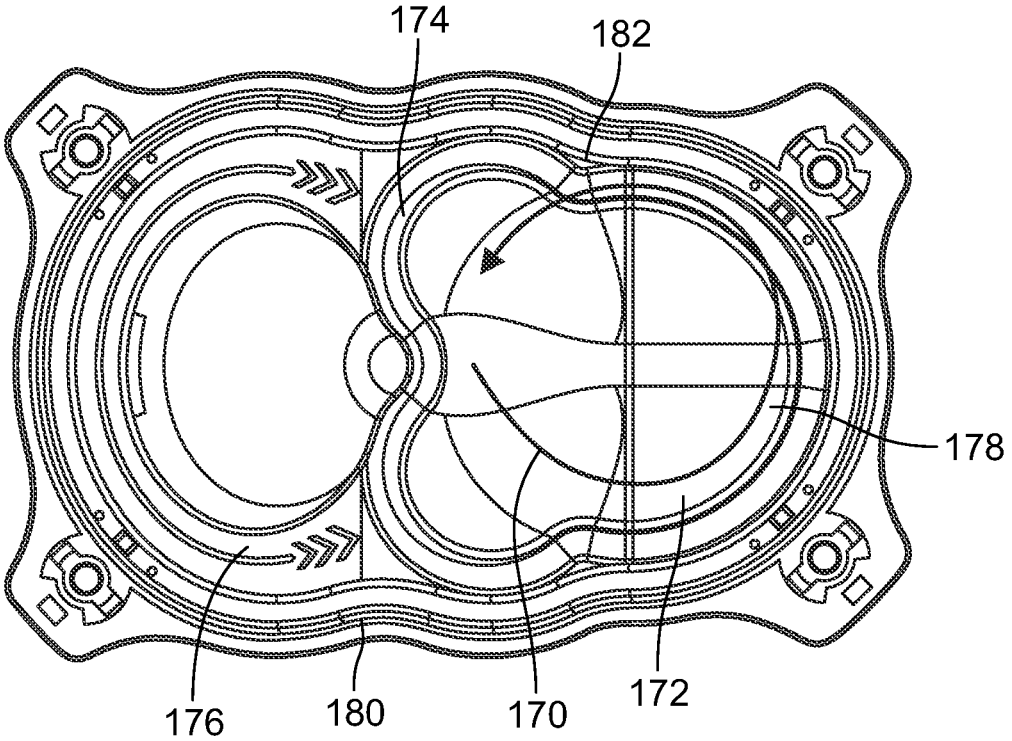

FIG. 24 illustrates a top toy path within the first embodiment arena showing potential top run trajectory therein as travel might proceed from the lower bowl onto its platform. As shown the housing wall shape contour 182 guides the top back toward the lower bowl.

Figure 25:
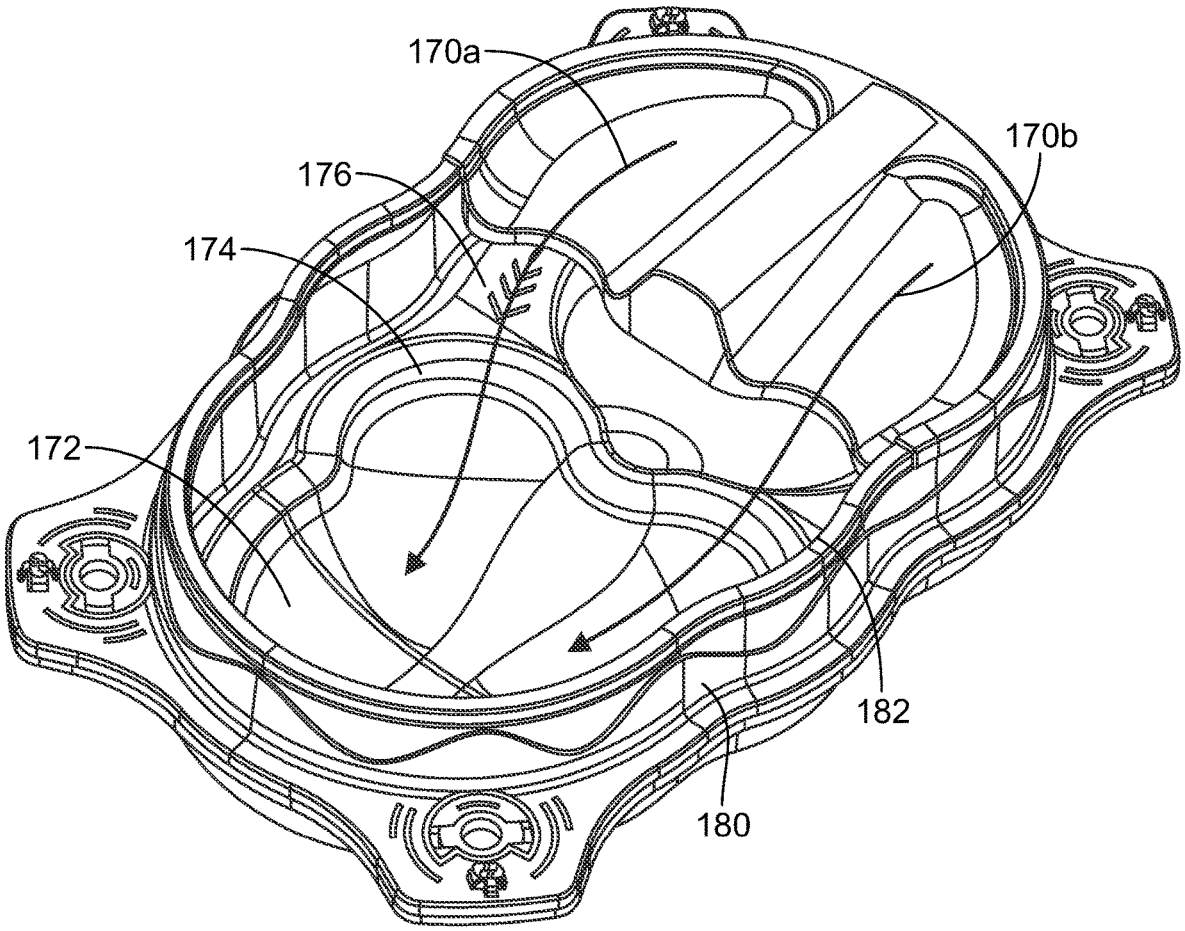

FIG. 25 illustrates top toy paths 170*a*, 170*b* within the first embodiment arena showing potential top run trajectory therein as travel might proceed as it travels from the insert into the lower bowl. The arena's geometry is symmetric, so the left spin and the right spin tops have similar trajectories. It gives no advantage to either top versions.

Figure 26:
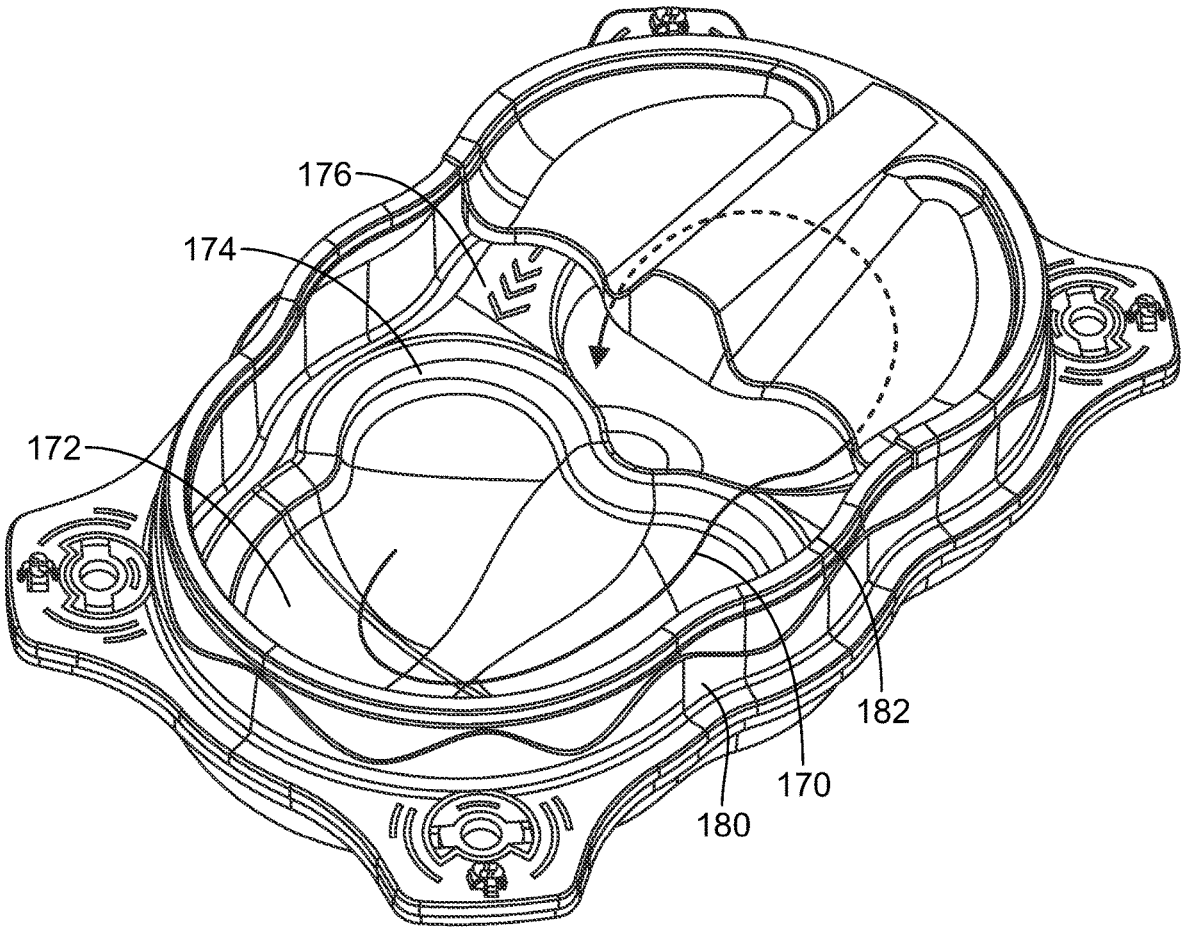
Figure 27:
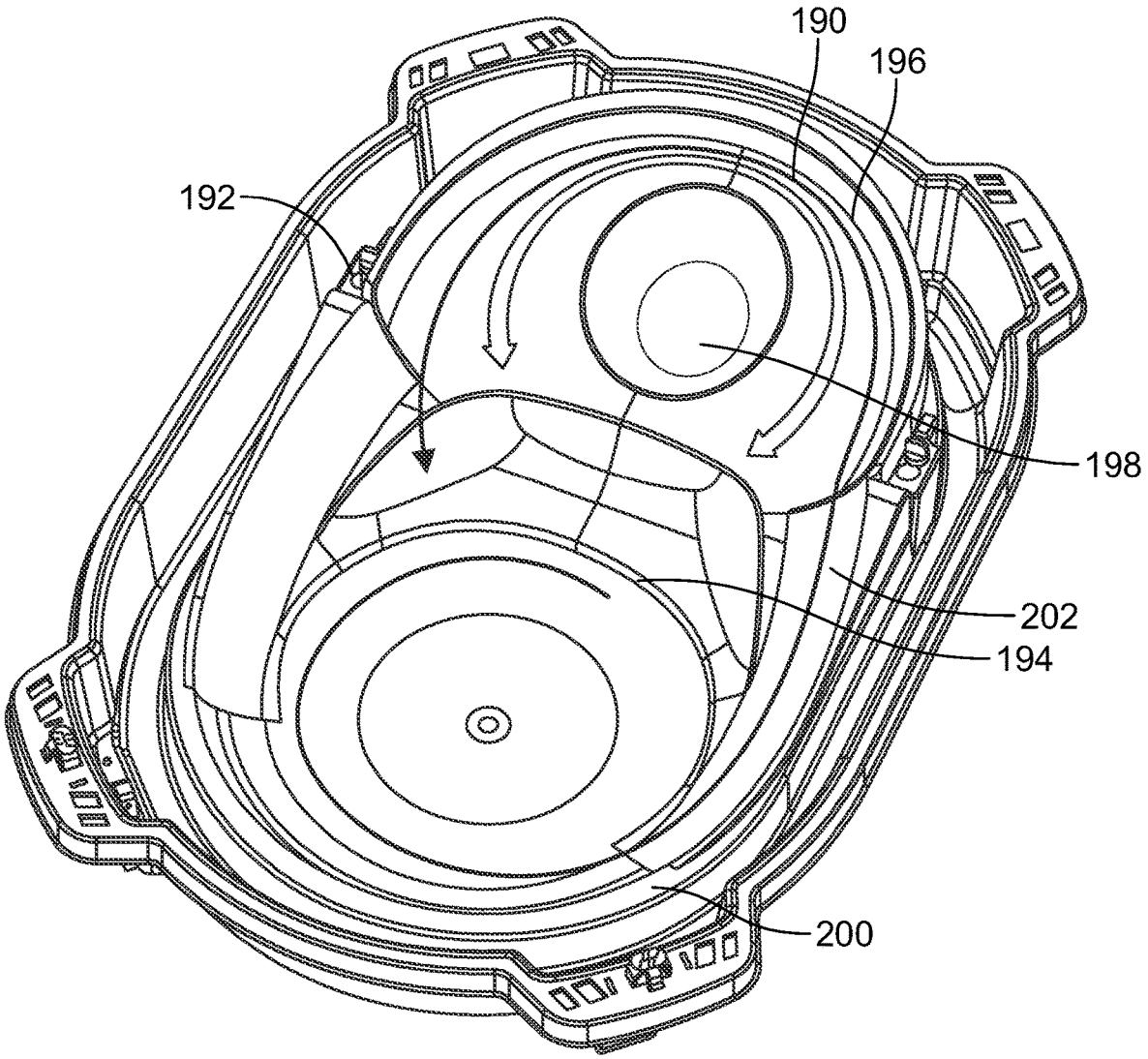
FIGS. 27 through 31 illustrate a top toy path within the second embodiment arena showing potential top run trajectory therein as travel might proceed as between lower and optionally inserted upper bowl configurations showing trajectory of travel between the lower bowl, ramps and insert.

FIG. 27 illustrates a top toy path 190 within the second embodiment arena showing potential top run trajectory therein as travel might proceed from the lower to the inserted upper bowl showing a trajectory of travel from the lower bowl, up the ramp and onto the insert. Insert's shape 192 guides the top toward the middle of the lower bowl. Insert edge 194 helps with starting the top's trajectory up the ramp. FIG. 26 illustrates a top toy path within the first embodiment arena showing potential top run trajectory therein as travel might proceed allowing tops to travel underneath the insert onto the upper bowl.

Figure 28:
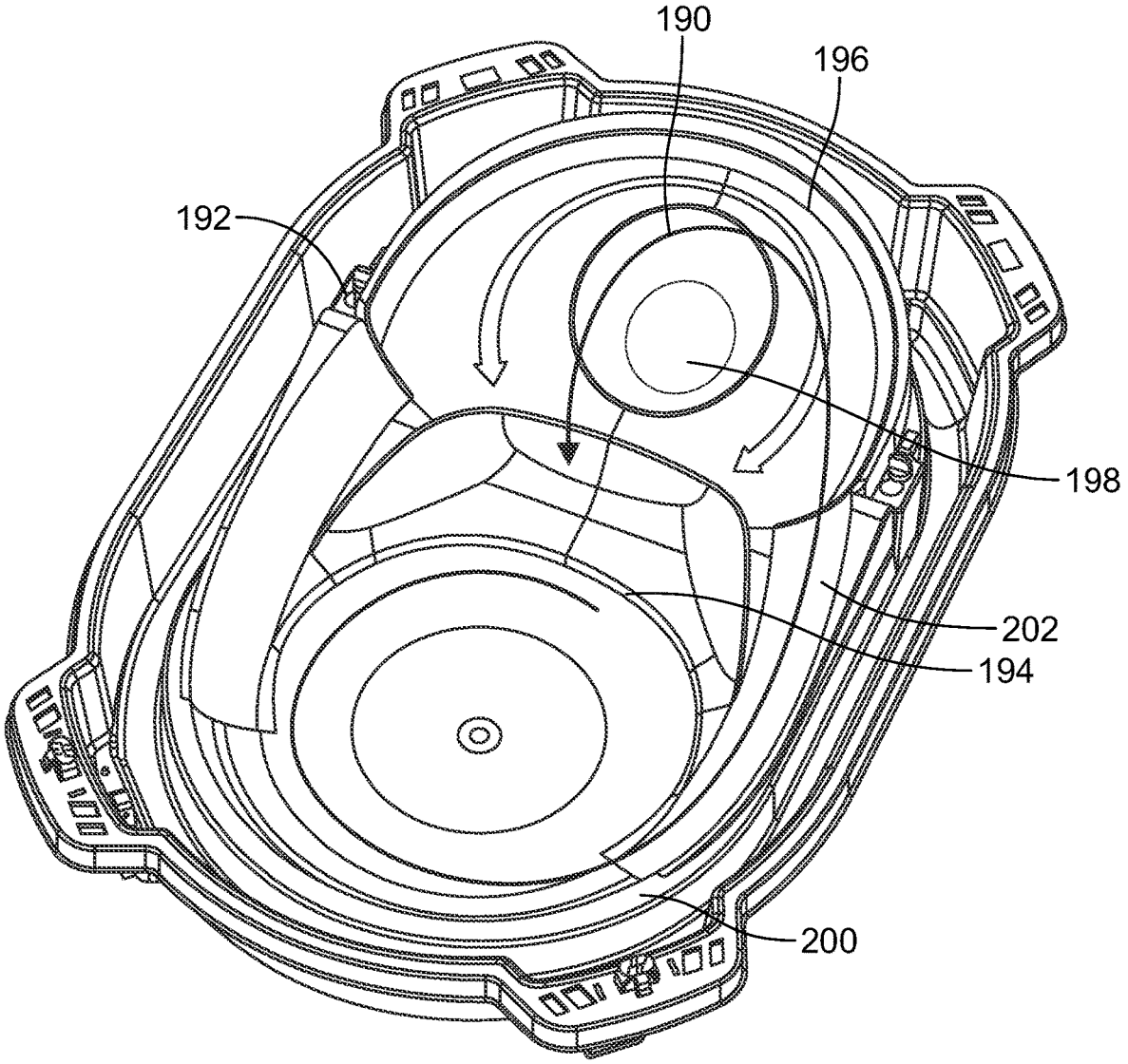
Figure 29:
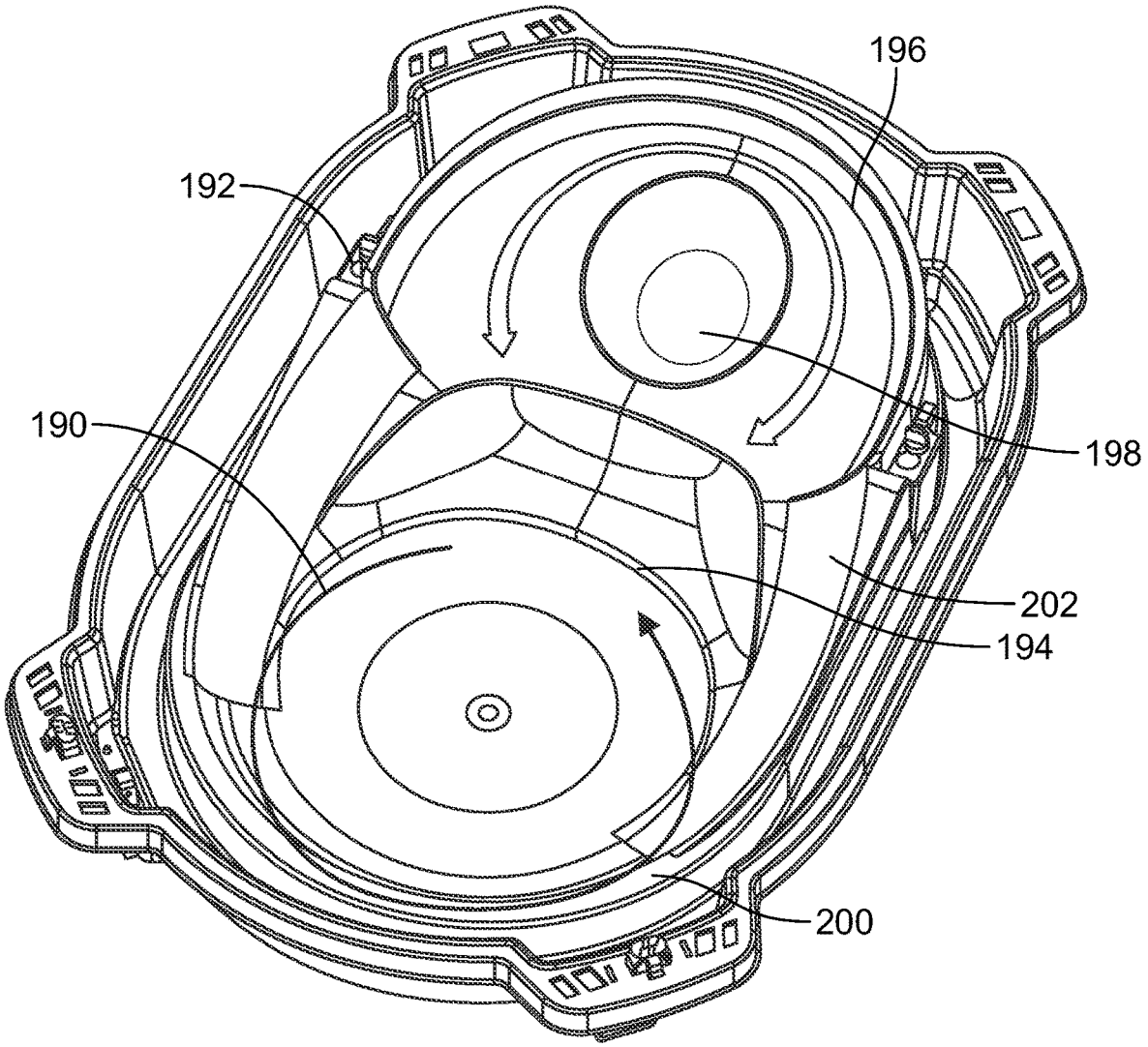
Figure 30:
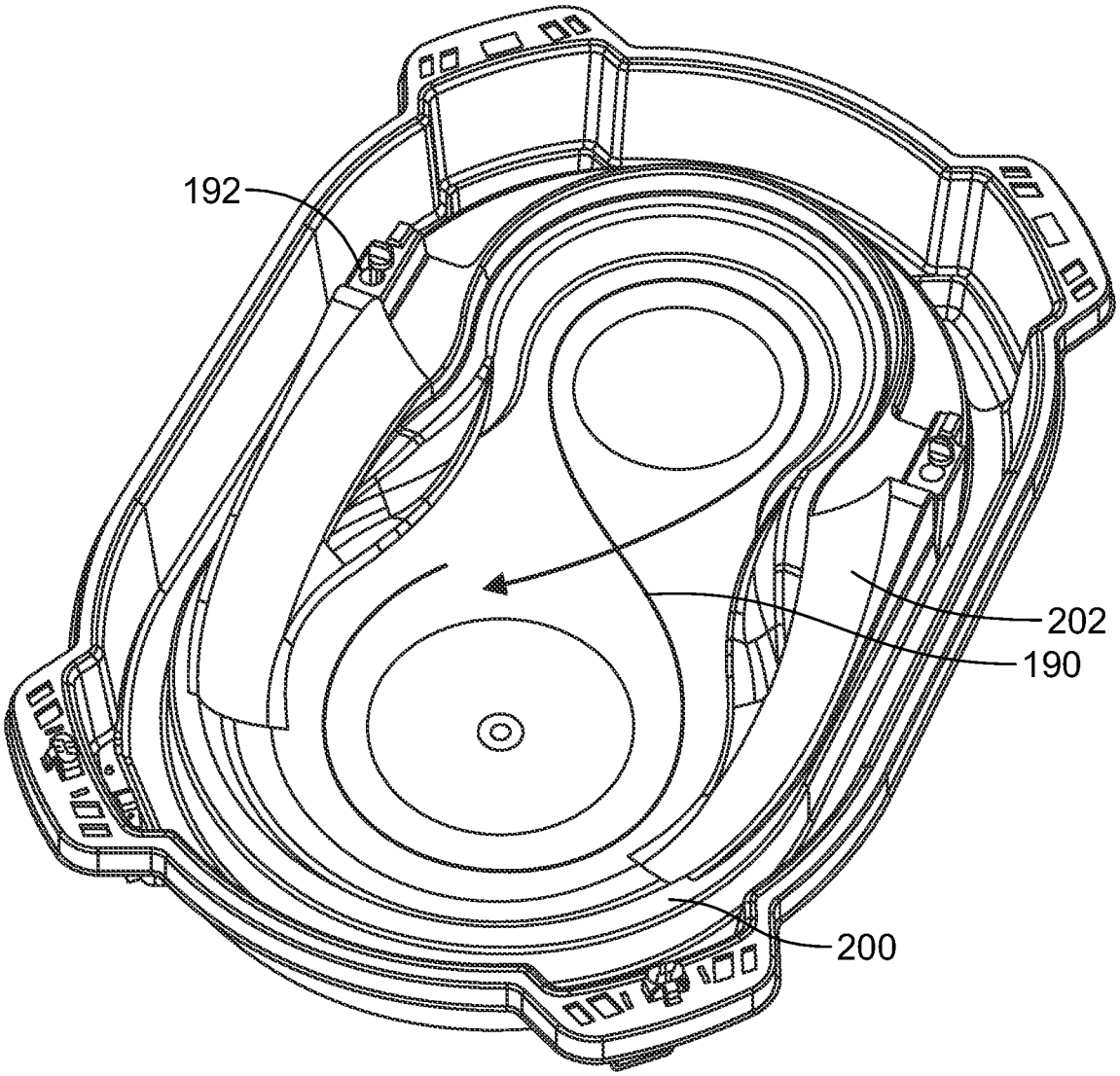
Figure 31:
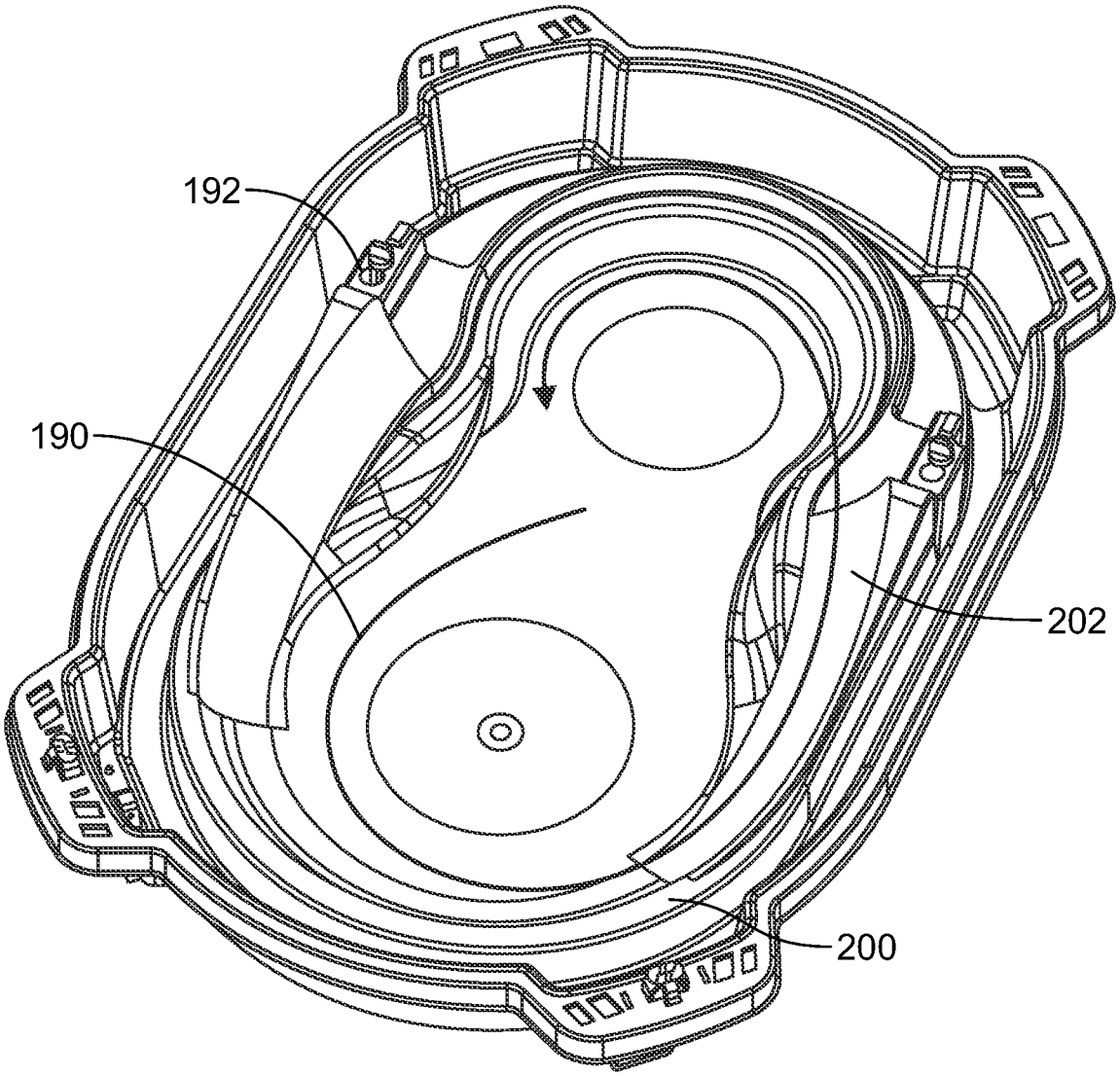

FIG. 28 illustrates a top toy path within the second embodiment arena showing potential top run trajectory therein as travel might proceed from the lower bowl, up the ramp 196 and onto inner bowl of the insert. Pocket 198 redirects the top's trajectory, making the motion more unpredictable. FIG. 29 illustrates a top toy path within the second embodiment arena showing potential top run trajectory therein as travel might proceed riding atop on the narrow platform surface 200 of the bowl. The shape is irregular, which helps contain the energy to the top. FIG. 30 illustrates a top toy path within the second embodiment arena showing potential top run trajectory wherein having the insert removed, showing a figure-eight path or the like as a potential travel trajectory which may proceed as travel within the lower play surface. Further, in an alternate configuration, FIG. 31 illustrates a top toy path within the second embodiment arena showing potential top run trajectory with a possibility that the top can climb the ramp 202 and jump into the smaller play surface area while having the insert removed.

From the foregoing, it can be seen that the present inventions provide unique battle arena game apparatus which accommodates multiple levels with various different battling environment and multiple play level surfaces and orientations. The arena includes multiple regions for guiding spinning toy battle tops to flow toward the battling surfaces for engaging the tops in combat to enhance game play and fun for the user. While particular embodiments and variations of the present invention have been shown and described in great detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations.

What is claimed is:

1. A stadium for a battle between spinning tops on predetermined fields, comprising:

a first surface member defining a first field of the stadium for battle between spinning tops on predetermined fields;

a second surface member defining a second field of the stadium for battle between spinning tops on predetermined fields that is at a higher level than the first field; and a slope connecting the first field to the second field to allow a spinning top to go up from the first field to the second field of the stadium for battle between spinning tops on predetermined fields wherein the first field and the second field are disposed next to each other in a predetermined direction in a plan view, the first surface member structured as a first play level surface and including at least one concave arena within the first field, wherein the slope comprises two slopes that are disposed respectively at opposite ends connecting the first field to the second field, further comprising: a transition section that is disposed at the second surface member between the first field and the second field, the transition section being disposed between the two slopes.

2. The stadium according to claim 1, wherein the two slopes are disposed in a direction perpendicular to the predetermined direction of the first and second fields.

3. The stadium according to claim 2, further comprising: a cliff that is disposed at an edge of the second surface member between the two slopes to allow a spinning top to fall from the second field to the first field, wherein an upper surface of the second surface member has a downward gradient toward the first field.

4. The stadium according to claim 3, further comprising: a step that is disposed between the first field and the cliff to prevent a body of a spinning top from contacting a wall of the cliff.

5. The stadium according to claim 4, wherein the slope has such a cant that allows a top to spin with an outer peripheral surface of a shaft of the top on the slope.

6. The stadium according to claim 5, wherein the cant of the slope gradually increases from the first field to the second field.

7. The stadium according to claim 6, further comprising: a bottom plate that includes the first surface member and a third surface member defining a third field continuous to the first field, wherein the second surface member is detachably disposed on the bottom plate to cover the third field, and the third field is exposed on the bottom plate when the second surface member is detached from the bottom plate.

8. The stadium according to claim 7, further comprising: a first fence that has a uniform height and is detachably disposed along an edge of the bottom plate to prevent a spinning top from going out of the bottom plate, and further comprising: a second fence that is detachably disposed on the first fence to surround the bottom plate except for a portion defining the first field so as to prevent a spinning top from going out of the second field, wherein the second surface member is a cantilever that is fixed on the bottom plate at an end facing the first field, and a free end of the second surface member is suspended from the second fence by a suspender.

9. The stadium according to claim 1, further comprising: a cliff that is disposed at an edge of the second surface member between the two slopes to allow a spinning top to fall from the second field to the first field.

10. The stadium according to claim 1, wherein an upper surface of the second surface member has a downward gradient toward the first field.

11. The stadium according to claim 1, wherein the second surface member is structured to include a curved inward concave portion within the second field.

12. The stadium according to claim 11, further comprising: a bottom plate that includes the first surface member.

13. A stadium for a battle between spinning tops on predetermined fields, comprising:

a first surface member defining a first field of the stadium for battle between spinning tops on predetermined fields;

a second surface member defining a second field of the stadium for battle between spinning tops on predetermined fields that is at a higher level than the first field; and a slope connecting the first field to the second field to allow a spinning top to go up from the first field to the second field of the stadium for battle between spinning tops on predetermined fields wherein the first field and the second field are disposed next to each other in a predetermined direction in a plan view, the first surface member structured as a first play level surface and including at least one concave arena within the first field, wherein the slope comprises two slopes that are disposed respectively at opposite ends connecting the first field to the second field, further comprising: a bottom plate that includes the first surface member and a third surface member defining a third field continuous to the first field.

14. The stadium according to claim 13, wherein the second surface member is detachably disposed on the bottom plate to cover the third field, and the third field is exposed on the bottom plate when the second surface member is detached from the bottom plate.

15. The stadium according to claim 13, further comprising: a first fence that has a uniform height and is detachably disposed along an edge of the bottom plate to prevent a spinning top from going out of the bottom plate.

16. The stadium according to claim 13, wherein the two slopes are disposed in a direction perpendicular to the predetermined direction of the first and second fields.

17. The stadium according to claim 13, wherein an upper surface of the second surface member has a downward gradient toward the first field.

18. The stadium according to claim 13, further comprising: a cliff that is disposed at an edge of the second surface member between the two slopes to allow a spinning top to fall from the second field to the first field.

19. The stadium according to claim 18, further comprising: a step that is disposed between the first field and the cliff to prevent a body of a spinning top from contacting a wall of the cliff.

20. The stadium according to claim 13, wherein the second surface member is structured to include a curved inward concave portion within the second field.

* * * * *